US010826160B2

(12) United States Patent
Kwak et al.

(10) Patent No.: US 10,826,160 B2
(45) Date of Patent: Nov. 3, 2020

(54) ELECTRONIC DEVICE COMPRISING ANTENNA

(71) Applicant: Samsung Electronics Co., Ltd., Suwon-si (KR)

(72) Inventors: Yong Soo Kwak, Seoul (KR); Gyu Sub Kim, Seoul (KR); Hae Yeon Kim, Suwon-si (KR); Se Hyun Park, Suwon-si (KR); Kyung Il Seo, Daegu (KR); Jung Hoon Seo, Hwaseong-si (KR); Dong Min Shin, Yongin-si (KR); Ui Chul Jeong, Anyang-si (KR); Jin Woo Jung, Seoul (KR); Young Jun Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/414,111

(22) Filed: May 16, 2019

(65) Prior Publication Data

US 2019/0273307 A1 Sep. 5, 2019

Related U.S. Application Data

(63) Continuation of application No. 15/665,933, filed on Aug. 1, 2017, now Pat. No. 10,305,170.

(30) Foreign Application Priority Data

Aug. 1, 2016 (KR) ..... 10-2016-0098238

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 1/48* (2013.01); *H01Q 5/35* (2015.01); *H01Q 9/42* (2013.01); *H01Q 21/30* (2013.01)

(58) Field of Classification Search
CPC ..... H01Q 1/243; H01Q 13/10; H01Q 9/0421; H01Q 9/42; H01Q 5/307; H01Q 13/106; H01Q 21/29; H01Q 5/00; H01Q 5/321
See application file for complete search history.

(56) References Cited

U.S. PATENT DOCUMENTS 6,108,308 A 8/2000 Flavin et al.
6,529,749 B1 * 3/2003 Hayes ..... H01Q 1/243 343/702
(Continued)

FOREIGN PATENT DOCUMENTS

CN 105024134 A 11/2015
KR 1990-0008877 A 6/1990
(Continued)

OTHER PUBLICATIONS

Extended European Search Report dated Jun. 17, 2018, issued in European Application No. 17837188.6.
(Continued)

*Primary Examiner* — Linh V Nguyen
(74) *Attorney, Agent, or Firm* — Jefferson IP Law, LLP

(57) ABSTRACT

An electronic device is provided. The electronic device includes a housing, a wireless communication circuit, a first antenna radiator electrically connected with a first ground, a second antenna radiator electrically connected with a second ground, a feeding unit that feeds at least one of the first antenna radiator or the second antenna radiator, and a first switch that operates at a first connection state where the feeding unit and the first antenna radiator are electrically connected to each other, at a second connection state where the feeding unit and the second antenna are electrically
(Continued)

connected to each other, or at a third connection state where the feeding unit and the first antenna radiator are connected to each other and the feeding unit and the second antenna radiator are electrically connected to each other, based on a first control signal from the wireless communication circuit.

8 Claims, 17 Drawing Sheets

(51) Int. Cl.
*H01Q 5/35* (2015.01)
*H01Q 1/48* (2006.01)
*H01Q 21/30* (2006.01)

(56) References Cited

U.S. PATENT DOCUMENTS 7,058,373 B2 6/2006 Grigore
7,084,529 B2 8/2006 Face et al.
7,379,714 B2 5/2008 Haque et al.
7,653,366 B2 1/2010 Grigore
7,747,231 B2 6/2010 Yoon et al.
8,625,472 B2 1/2014 Fan
8,866,683 B2 10/2014 Wong et al.
8,891,649 B2 11/2014 Choi et al.
8,897,730 B2 11/2014 Zhao
8,942,644 B2 1/2015 Schell
9,035,837 B2 5/2015 Kwak et al.
9,037,096 B2 5/2015 Kok
9,184,903 B2 11/2015 Fan
9,219,305 B2 12/2015 Lee et al.
9,559,422 B2 1/2017 Wong et al.
9,608,337 B2 3/2017 Lee et al.
9,685,703 B2 * 6/2017 Kao ..... H01Q 9/0421
9,905,913 B2 2/2018 Hung et al.
10,305,170 B2 * 5/2019 Kwak ..... H01Q 5/35
2003/0193417 A1 10/2003 Face et al.
2005/0064830 A1 3/2005 Grigore
2005/0227640 A1 10/2005 Haque et al.
2006/0097918 A1 * 5/2006 Oshiyama ..... H01Q 9/42 343/700 MS
2006/0250825 A1 11/2006 Grigore
2007/0004350 A1 1/2007 Yoon et al.
2007/0066345 A1 3/2007 Hwang et al.
2007/0285321 A1 * 12/2007 Chung ..... H01Q 7/00 343/702
2008/0214125 A1 9/2008 Haque et al.
2008/0287163 A1 11/2008 Skarby et al.
2009/0128428 A1 * 5/2009 Ishizuka ..... H01Q 5/328 343/702
2010/0149067 A1 6/2010 Williams et al.
2010/0151908 A1 6/2010 Skarby et al.
2011/0249715 A1 10/2011 Choi et al.
2012/0294205 A1 11/2012 Fan et al.
2012/0299785 A1 * 11/2012 Bevelacqua ..... H01Q 13/10 343/702
2013/0038494 A1 * 2/2013 Kuonanoja ..... H01Q 9/42 343/746
2013/0122824 A1 5/2013 Schell
2013/0127685 A1 * 5/2013 Ikehata ..... H01Q 21/24 343/876
2013/0135157 A1 5/2013 Tsou et al.
2013/0234903 A1 9/2013 Kwak et al.
2013/0241798 A1 * 9/2013 Lee ..... H01Q 1/243 343/876
2013/0257679 A1 10/2013 Wong et al.
2014/0092791 A1 4/2014 Fan
2014/0187175 A1 7/2014 Zhao
2014/0256271 A1 9/2014 Kok
2014/0327584 A1 11/2014 Chang et al.
2014/0354508 A1 * 12/2014 Lee ..... H01Q 5/30 343/860
2015/0071379 A1 3/2015 Choi et al.
2015/0123871 A1 5/2015 Chang et al.
2015/0145744 A1 5/2015 Kao et al.
2015/0200834 A1 7/2015 Yun et al.
2015/0255854 A1 9/2015 Lin et al.
2015/0296515 A1 10/2015 Pehlivanoglu
2015/0311588 A1 * 10/2015 Wong ..... H01Q 7/00 342/374
2016/0079683 A1 3/2016 Lee et al.
2016/0276748 A1 9/2016 Ramachandran et al.
2017/0012347 A1 1/2017 Ohguchi et al.
2017/0033440 A1 2/2017 Kim et al.
2017/0162933 A1 6/2017 Xiong et al.
2017/0194695 A1 7/2017 Wang et al.
2018/0083343 A1 3/2018 Choon et al.

FOREIGN PATENT DOCUMENTS

KR 10-0269530 B1 10/2000
KR 10-2000-0065328 A 11/2000
KR 10-2001-0064947 A 7/2001
KR 10-2002-0087958 A 11/2002
KR 10-2003-0040981 A 5/2003
KR 10-2004-0031713 A 4/2004
KR 10-2005-0045686 A 5/2005
KR 10-2006-0037466 A 5/2006
KR 10-2006-0125921 A 12/2006
KR 10-2007-0000261 A 1/2007
KR 10-2007-0001478 A 1/2007
KR 10-0664221 B1 1/2007
KR 10-2007-0022153 A 2/2007
KR 10-2007-0042582 A 4/2007
KR 10-2007-0043336 A 4/2007
KR 10-2007-0086673 A 8/2007
KR 10-0753367 B1 8/2007
KR 10-0871469 B1 12/2008
KR 10-2010-0016074 A 2/2010
KR 10-2010-0063414 A 6/2010
KR 10-2011-0114175 A 10/2011
KR 10-2013-0082353 A 7/2013
KR 10-2013-0111162 A 10/2013
KR 10-2014-0031403 A 3/2014
KR 10-2014-0034828 A 3/2014
KR 10-2014-0088024 A 7/2014
KR 10-2014-0089423 A 7/2014
KR 10-1505456 B1 3/2015
KR 10-2015-0039207 A 4/2015
KR 10-1545147 B1 8/2015
KR 10-2015-0118053 A 10/2015
KR 10-2015-0122126 A 10/2015
KR 10-2016-0000468 A 1/2016
TW 201521283 A 6/2015
WO 2015/125383 A1 8/2015

OTHER PUBLICATIONS

Chinese Office Action dated May 27, 2020, issued in Chinese Application No. 201780048034.X.

* cited by examiner

ELECTRONIC DEVICE COMPRISING ANTENNA

CROSS-REFERENCE TO RELATED APPLICATION(S)

This application is a continuation application of prior application Ser. No. 15/665,933, filed on Aug. 1, 2017, which has issued as U.S. Pat. No. 10,305,170 on May 28, 2019 and was based on and claimed priority under 35 U.S.C § 119(a) of a Korean patent application number 10-2016-0098238, filed on Aug. 1, 2016, in the Korean Intellectual Property Office, the disclosure of which is incorporated by reference herein in its entirety.

TECHNICAL FIELD

The present disclosure relates to an electronic device including an antenna. More particularly, the present disclosure relates to an antenna that transmits and receives a signal of a frequency band required in various standard technologies while a metal material used to form part of an outer housing of an electronic device is used as an antenna radiator and an electronic device including the same.

BACKGROUND

With the development of mobile communication technologies, nowadays, an electronic device changes is implemented to freely connect to a wireless/wired network. For example, since a portable electronic device, such as a smartphone, a tablet personal computer (PC), or the like includes an antenna for transmitting and receiving a wireless signal, the portable electronic device may connect to a wireless communication network.

The antenna may be implemented by attaching or coating a metal pattern to or on synthetic resin injection-molding (e.g., a carrier) of specific thickness and volume, by forming a conductive pattern in a flexible printed circuit board (FPCB), by using laser direct structuring (LDS), or by designing a pattern directly on a printed circuit board (PCB), so called, with a PCB embedded antenna (PEA).

As a metal material is used as a material of the exterior of an electronic device, the metal material of the exterior of the electronic device is used as an antenna radiator. As such, if an external structure of a metal material is used as an antenna, the metal material causes various limits in design in that the antenna constitutes part of an outer appearance of the electronic device. For example, since a length of the metal material used to form the exterior of the electronic device is fixed, an antenna is designed to have fixed radiation performance in a specific resonant frequency band. Due to the structural limit, it is difficult to satisfy three-carrier aggregation (3CA)/4CA/5CA, (4R×D), 4×4 multiple-input and multiple-output (MIMO), a mobile communication standard technology, and a condition for each nation or region.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna that transmits and receives a signal of a frequency band required in various standard technologies while a metal material used to form part of an outer housing of an electronic device is used as an antenna radiator and an electronic device including the same.

In accordance with an aspect of the present disclosure, an electronic device is provided. The electronic device includes a housing, a wireless communication circuit, a first antenna radiator electrically connected with a first ground, a second antenna radiator electrically connected with a second ground, a feeding unit that feeds at least one of the first antenna radiator or the second antenna radiator, and a first switch that operates at a first connection state where the feeding unit the first antenna radiator are electrically connected to each other, at a second connection state where the feeding unit and the second antenna are electrically connected to each other, or at a third connection state where the feeding unit and the first antenna radiator are connected to each other and the feeding unit and the second antenna radiator are electrically connected to each other, based on a first control signal from the wireless communication circuit.

In accordance with another aspect of the present disclosure, an electronic device is provided. The electronic device includes a wireless communication circuit, a first antenna radiator, a second antenna radiator, a first ground electrically connected with the first antenna element, a second ground associated with the first antenna element, a third ground electrically connected with the second antenna element, a first feeding unit that feeds the first antenna radiator, a second feeding unit that feeds at least one of the first antenna radiator and the second antenna radiator, and a switch that electrically connects at least two or more of the first antenna radiator, the second antenna radiator, the second ground, and the second feeding unit based on a control signal from the wireless communication circuit.

In accordance with another aspect of the present disclosure, an electronic device is provided. The electronic device includes a wireless communication circuit, a first feeding unit, a second feeding unit, a first antenna radiator, a second antenna radiator, a first ground associated with the first antenna element, a second ground associated with the first antenna element, a third ground electrically connected with the second antenna element, and a first switch that electrically connects at least two or more of the first feeding unit, the second feeding unit, the first antenna radiator, the second antenna radiator, and the second ground based on a first control signal from the wireless communication circuit.

In accordance with another aspect of the present disclosure, an electronic device is provided. The electronic device includes a housing, a display that is exposed through a first part of the housing, a first antenna radiator that is located within the housing or forms part of the housing, a second antenna radiator that is located within the housing or forms another part of the housing, a wireless communication circuit that transmits and/or receives a signal of a first frequency band, a switching circuit that includes a first port electrically connected with a first position of the first antenna radiator, a second port electrically connected with a second position of the second antenna radiator, and a third position electrically connected with the wireless communication circuit, and a control circuit electrically connected with the switching circuit. The control circuit may provide one state selected from a first state where an electrical path is formed only between the first port and the second port, at a second state where an electrical path is formed only between the second port and the third port, or at a third state where electrical paths are formed between the first port, the second port, and the third port.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
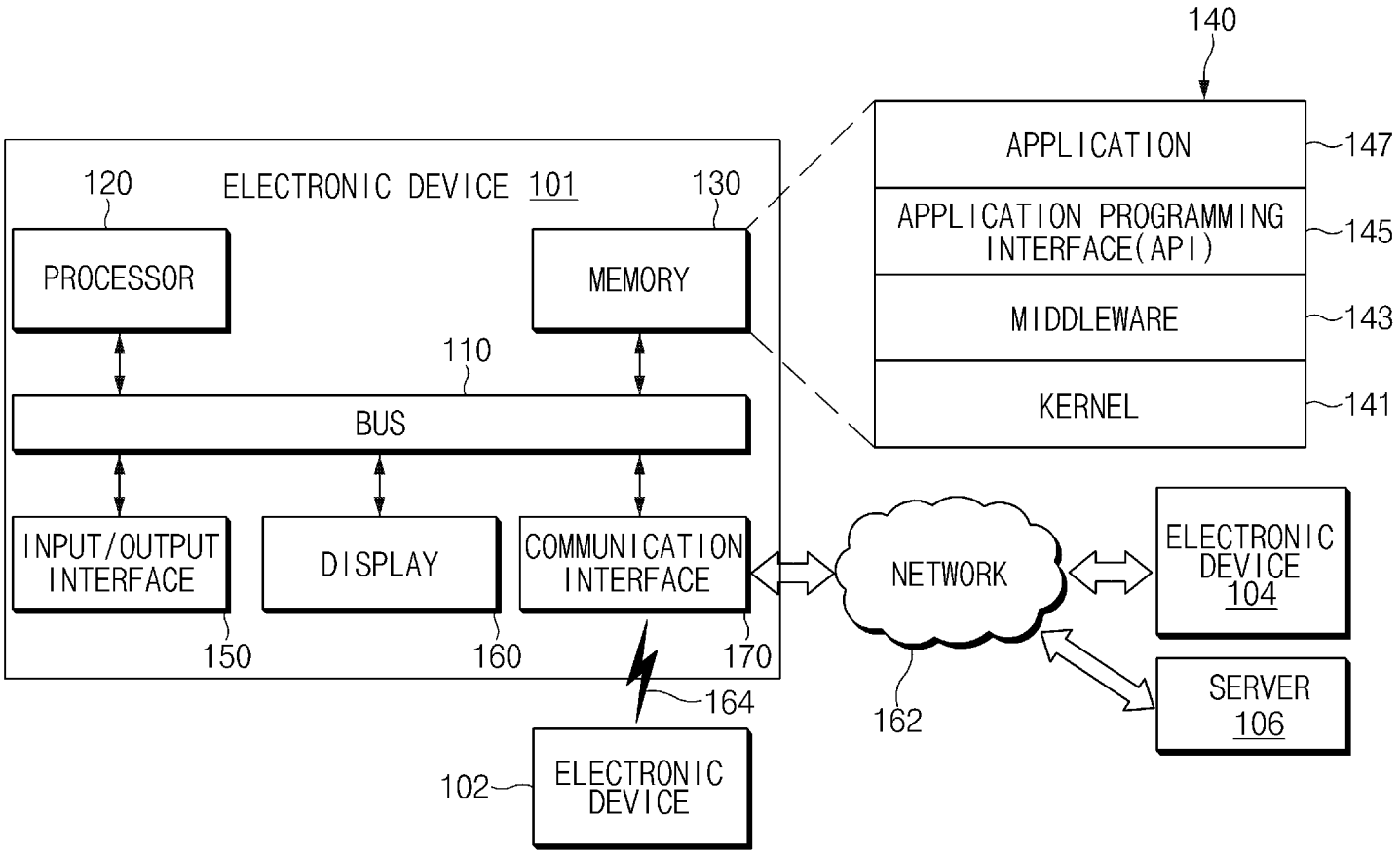
FIG. 1 illustrates an electronic device in a network environment according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, description of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In this disclosure, the expressions "have", "may have", "include" and "comprise", or "may include" and "may comprise" indicate existence of corresponding features (e.g., elements, such as numeric values, functions, operations, or components) but do not exclude presence of additional features.

In this disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or the priority. For example, without departing the scope of this disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there is no intervening element (e.g., a third element).

According to the situation, the expression "configured to" used in this disclosure may be used as, for example, the expression "suitable for", "having the capacity to", "designed to", "adapted to", "made to", or "capable of." The term "configured to" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor (AP)) which performs corresponding operations by executing one or more software programs which are stored in a memory device.

Terms used in this disclosure are used to describe specified embodiments and are not intended to limit the scope of another embodiment. The terms of a singular form may include plural forms unless otherwise specified. All the terms used herein, which include technical or scientific terms, may have the same meaning that is generally understood by those skilled in the art. It will be further understood that terms, which are defined in a dictionary and commonly used, should also be interpreted as being customary in the relevant art and not in an idealized or overly formal unless expressly so defined in various embodiments of this disclosure. In some cases, even if certain terms are defined in this disclosure, they may not be interpreted to exclude embodiments of this disclosure.

An electronic device according to various embodiments of this disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), moving picture experts group (MPEG-1 or MPEG-2) audio layer 3 (MP3) players, mobile medical devices, cameras, or wearable devices. According to various embodiments of the present disclosure, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments of the present disclosure, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, and Google TV™), game consoles (e.g., Xbox™ and PlayStation™), electronic dictionaries, electronic keys, camcorders, electronic picture frames, and the like.

According to another embodiment of the present disclosure, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment of the present disclosure, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments of the present disclosure, the electronic device may be one of the above-described devices or a combination thereof. An electronic device according to an embodiment may be a flexible electronic device. Furthermore, an electronic device according to an embodiment of this disclosure may not be limited to the above-described electronic devices and may include other electronic devices and new electronic devices according to the development of technologies.

Hereinafter, electronic devices according to various embodiments will be described with reference to the accompanying drawings. In this disclosure, the term "user" may refer to a person who uses an electronic device or may refer to a device (e.g., an artificial intelligence electronic device) that uses the electronic device.

FIG. 1 illustrates a block diagram of an electronic device in a network environment according to an embodiment of the present disclosure.

Referring to FIG. 1, according to various embodiments of the present disclosure, electronic devices 101, 102, or 104 or a server 106 may be connected with each other over a network 162 or local wireless communication 164. The electronic device 101 may include a bus 110, a processor 120, a memory 130, an input/output interface 150, a display 160, and a communication interface 170. According to an embodiment of the present disclosure, the electronic device 101 may not include at least one of the above-described elements or may further include other element(s).

For example, the bus 110 may interconnect the above-described elements 110 to 170 and may include a circuit for conveying communications (e.g., a control message and/or data) among the above-described elements.

The processor 120 may include one or more of a CPU, an AP, or a communication processor (CP). For example, the processor 120 may perform an arithmetic operation or data processing associated with control and/or communication of at least one other element(s) of the electronic device 101.

The memory 130 may include a volatile and/or nonvolatile memory. For example, the memory 130 may store instructions or data associated with at least one other element(s) of the electronic device 101. According to an embodiment of the present disclosure, the memory 130 may store software and/or a program 140. The program 140 may include, for example, a kernel 141, a middleware 143, an application programming interface (API) 145, and/or an application program (or "an application") 147. At least a part of the kernel 141, the middleware 143, or the API 145 may be referred to as an "operating system (OS)."

For example, the kernel 141 may control or manage system resources (e.g., the bus 110, the processor 120, the memory 130, and the like) that are used to execute operations or functions of other programs (e.g., the middleware 143, the API 145, and the application program 147). Furthermore, the kernel 141 may provide an interface that allows the middleware 143, the API 145, or the application program 147 to access discrete elements of the electronic device 101 so as to control or manage system resources.

The middleware 143 may perform, for example, a mediation role such that the API 145 or the application program 147 communicates with the kernel 141 to exchange data.

Furthermore, the middleware 143 may process one or more task requests received from the application program 147 according to a priority. For example, the middleware 143 may assign the priority, which makes it possible to use a system resource (e.g., the bus 110, the processor 120, the memory 130, or the like) of the electronic device 101, to at least one of the application program 147. For example, the middleware 143 may process the one or more task requests according to the priority assigned to the at least one, which makes it possible to perform scheduling or load balancing on the one or more task requests.

The API 145 may be, for example, an interface through which the application program 147 controls a function provided by the kernel 141 or the middleware 143, and may include, for example, at least one interface or function (e.g., an instruction) for a file control, a window control, image processing, a character control, or the like.

The input/output interface 150 may play a role, for example, of an interface which transmits an instruction or data input from a user or another external device, to other element(s) of the electronic device 101. Furthermore, the input/output interface 150 may output an instruction or data, received from other element(s) of the electronic device 101, to a user or another external device.

The display 160 may include, for example, a liquid crystal display (LCD), a light-emitting diode (LED) display, an organic LED (OLED) display, a microelectromechanical systems (MEMS) display, or an electronic paper display. The display 160 may display, for example, various contents (e.g., a text, an image, a video, an icon, a symbol, and the like) to a user. The display 160 may include a touch screen and may receive, for example, a touch, gesture, proximity, or hovering input using an electronic pen or a part of a user's body.

For example, the communication interface 170 may establish communication between the electronic device 101 and an external device (e.g., the first external electronic device 102, the second external electronic device 104, or the server 106). For example, the communication interface 170 may be connected to the network 162 over wireless communication or wired communication to communicate with the external device (e.g., the second external electronic device 104 or the server 106).

The wireless communication may include cellular communication employing at least one of, for example, long-term evolution (LTE), LTE Advanced (LTE-A), code division multiple access (CDMA), wideband CDMA (WCDMA), universal mobile telecommunications system (UMTS), wireless broadband (WiBro), global system for mobile communications (GSM), or the like, as cellular communication protocol. According to an embodiment of the present disclosure, the wireless communication may include, for example, at least one of Wi-Fi, Bluetooth (BT), Bluetooth low energy (BLE), Zigbee, near field communication (NFC), magnetic stripe transmission (MST), radio frequency (RF), a body area network (BAN), and a global navigation satellite system (GNSS).

The MST may generate a pulse in response to transmission data using an electromagnetic signal, and the pulse may generate a magnetic field signal. The electronic device 101 may transfer the magnetic field signal to point of sale (POS), and the POS may detect the magnetic field signal using a MST reader. The POS may recover the data by converting the detected magnetic field signal to an electrical signal.

The GNSS may include at least one of, for example, a global positioning system (GPS), a global navigation satellite system (Glonass), a Beidou navigation satellite system (Beidou), or a European global satellite-based navigation system (Galileo) based on an available region, a bandwidth, or the like. Hereinafter, in this disclosure, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 162 may include at least one of telecommunications networks, for example, a computer network (e.g., LAN or WAN), an Internet, or a telephone network.

Each of the first and second external electronic devices 102 and 104 may be a device of which the type is different from or the same as that of the electronic device 101. According to an embodiment of the present disclosure, the server 106 may include a group of one or more servers. According to various embodiments of the present disclosure, all or a portion of operations performed in the electronic device 101 may be executed by another or plural electronic devices (e.g., the electronic devices 102 and 104 or the server 106). According to an embodiment of the present disclosure, in the case where the electronic device 101 executes any function or service automatically or in response to a request, the electronic device 101 may not perform the function or the service internally, but, alternatively additionally, it may request at least a portion of a function associated with the electronic device 101 at other device (e.g., the electronic device 102 or 104 or the server 106). The other electronic device (e.g., the electronic device 102 or 104 or the server 106) may execute the requested function or additional function and may transmit the execution result to the electronic device 101. The electronic device 101 may provide the requested function or service using the received result or may additionally process the received result to provide the requested function or service. To this end, for example, cloud computing, distributed computing, or client-server computing may be used.

Figure 2:
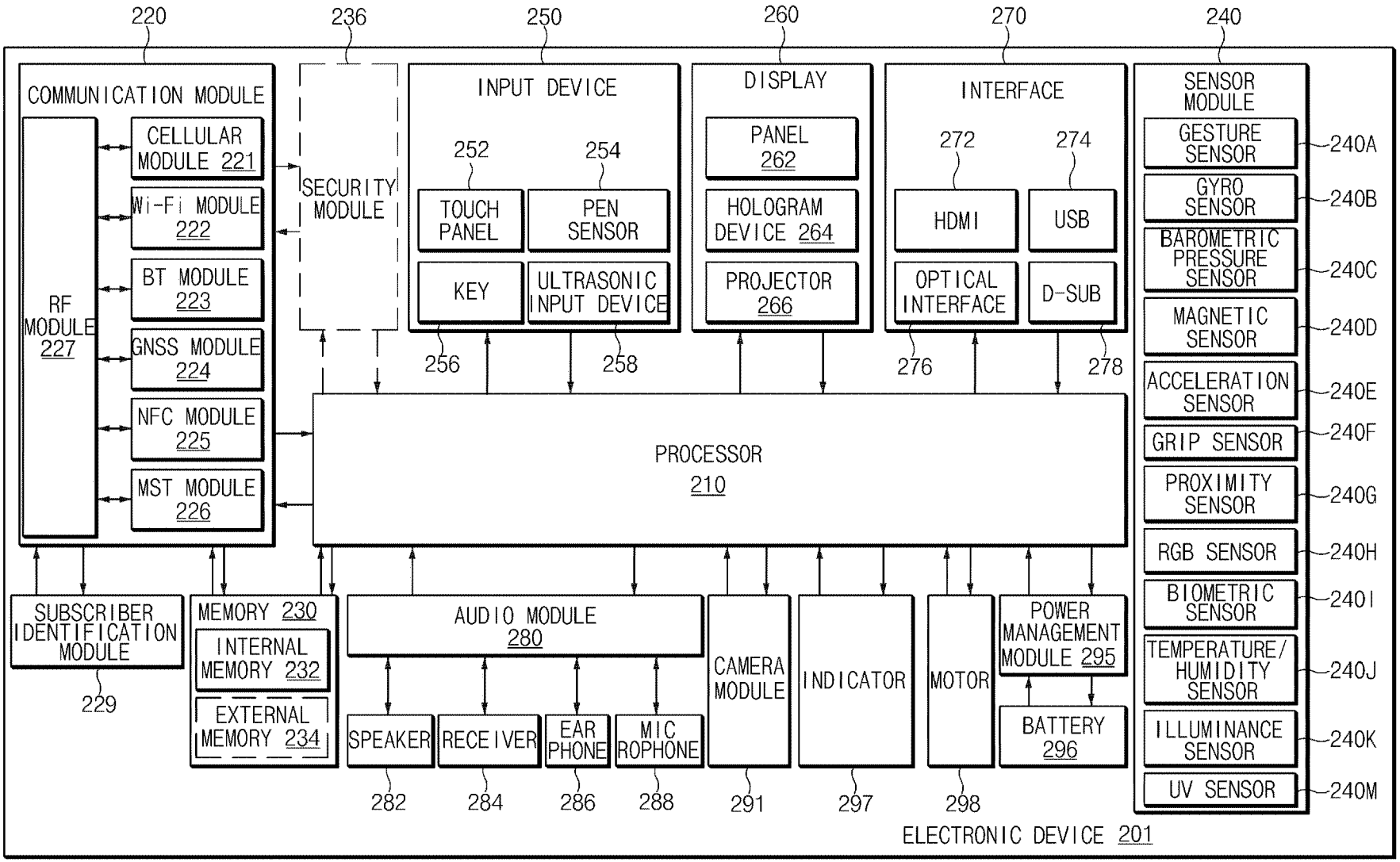
FIG. 2 illustrates a block diagram of an electronic device according to an embodiment of the present disclosure.

FIG. 2 illustrates a block diagram of an electronic device according to an embodiment of the present disclosure.

Referring to FIG. 2, an electronic device 201 may include, for example, an entire part or a part of the electronic device 101 illustrated in FIG. 1. The electronic device 201 may include one or more processors (e.g., an AP) 210, a communication module 220, a subscriber identification module 229, a memory 230, a sensor module 240, an input device 250, a display 260, an interface 270, an audio module 280, a camera module 291, a power management module 295, a battery 296, an indicator 297, and a motor 298.

The processor 210 may operate, for example, an OS or an application to control a plurality of hardware or software elements connected to the processor 210 and may process and compute a variety of data. For example, the processor 210 may be implemented with a system on chip (SoC). According to an embodiment of the present disclosure, the processor 210 may further include a graphic processing unit (GPU) and/or an image signal processor. The processor 210 may include at least a part (e.g., a cellular module 221) of elements illustrated in FIG. 2. The processor 210 may load an instruction or data, which is received from at least one of other elements (e.g., a nonvolatile memory), into a volatile memory and process the loaded instruction or data. The processor 210 may store a variety of data in the nonvolatile memory.

The communication module 220 may be configured the same as or similar to the communication interface 170 of FIG. 1. The communication module 220 may include the cellular module 221, a Wi-Fi module 222, a BT module 223, a GNSS module 224 (e.g., a GPS module, a Glonass module, a Beidou module, or a Galileo module), a NFC module 225, a MST module 226, and a radio frequency (RF) module 227.

The cellular module 221 may provide, for example, voice communication, video communication, a character service, an Internet service, or the like over a communication network. According to an embodiment of the present disclosure, the cellular module 221 may perform discrimination and authentication of the electronic device 201 within a communication network by using the subscriber identification module (e.g., a SIM card) 229. According to an embodiment of the present disclosure, the cellular module 221 may perform at least a portion of functions that the processor 210 provides. According to an embodiment of the present disclosure, the cellular module 221 may include a communication processor (CP).

Each of the Wi-Fi module 222, the BT module 223, the GNSS module 224, the NFC module 225, or the MST module 226 may include a processor for processing data exchanged through a corresponding module, for example. According to an embodiment of the present disclosure, at least a part (e.g., two or more) of the cellular module 221, the Wi-Fi module 222, the BT module 223, the GNSS module 224, the NFC module 225, or the MST module 226 may be included within one integrated circuit (IC) or an IC package.

For example, the RF module 227 may transmit and receive a communication signal (e.g., an RF signal). For example, the RF module 227 may include a transceiver, a power amplifier module (PAM), a frequency filter, a low noise amplifier (LNA), an antenna, or the like. According to another embodiment of the present disclosure, at least one of the cellular module 221, the Wi-Fi module 222, the BT module 223, the GNSS module 224, the NFC module 225, or the MST module 226 may transmit and receive an RF signal through a separate RF module.

The subscriber identification module 229 may include, for example, a card and/or embedded SIM that includes a subscriber identification module and may include unique identify information (e.g., integrated circuit card identifier (ICCID)) or subscriber information (e.g., international mobile subscriber identity (IMSI)).

The memory 230 (e.g., the memory 130) may include an internal memory 232 or an external memory 234. For example, the internal memory 232 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 234 may further include a flash drive, such as compact flash (CF), secure digital (SD), micro secure digital (Micro-SD), mini secure digital (Mini-SD), extreme digital (xD), a multimedia card (MMC), a memory stick, or the like. The external memory 234 may be operatively and/or physically connected to the electronic device 201 through various interfaces.

A security module 236 may be a module that includes a storage space of which a security level is higher than that of the memory 230 and may be a circuit that guarantees safe data storage and a protected execution environment. The security module 236 may be implemented with a separate circuit and may include a separate processor. For example, the security module 236 may be in a smart chip or an SD card, which is removable, or may include an embedded secure element (eSE) embedded in a fixed chip of the electronic device 201. Furthermore, the security module 236 may operate based on an OS that is different from the OS of the electronic device 201. For example, the security module 236 may operate based on java card open platform (JCOP) OS.

The sensor module 240 may measure, for example, a physical quantity or may detect an operation state of the electronic device 201. The sensor module 240 may convert the measured or detected information to an electric signal. For example, the sensor module 240 may include at least one of a gesture sensor 240A, a gyro sensor 240B, a barometric pressure sensor 240C, a magnetic sensor 240D, an acceleration sensor 240E, a grip sensor 240F, the proximity sensor 240G, a color sensor 240H (e.g., red, green, blue (RGB) sensor), a biometric sensor 240I, a temperature/humidity sensor 240J, an illuminance sensor 240K, or an ultra-violet (UV) sensor 240M. Although not illustrated, additionally or generally, the sensor module 240 may further include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling at least one or more sensors included therein. According to an embodiment of the present disclosure, the electronic device 201 may further include a processor that is a part of the processor 210 or independent of the processor 210 and is configured to control the sensor module 240. The processor may control the sensor module 240 while the processor 210 remains at a sleep state.

The input device 250 may include, for example, a touch panel 252, a (digital) pen sensor 254, a key 256, or an ultrasonic input unit 258. For example, the touch panel 252 may use at least one of capacitive, resistive, infrared and ultrasonic detecting methods. In addition, the touch panel 252 may further include a control circuit. The touch panel 252 may further include a tactile layer to provide a tactile reaction to a user.

The (digital) pen sensor 254 may be, for example, a part of a touch panel or may include an additional sheet for recognition. The key 256 may include, for example, a physical button, an optical key, or a keypad. The ultrasonic input device 258 may detect (or sense) an ultrasonic signal, which is generated from an input device, through a microphone (e.g., a microphone 288) and may determine data corresponding to the detected ultrasonic signal.

The display 260 (e.g., the display 160) may include a panel 262, a hologram device 264, or a projector 266. The panel 262 may be the same as or similar to the display 160 illustrated in FIG. 1. The panel 262 may be implemented, for example, to be flexible, transparent or wearable. The panel 262 and the touch panel 252 may be integrated into a single module. The hologram device 264 may display a stereoscopic image in a space using a light interference phenomenon. The projector 266 may project light onto a screen so as to display an image. For example, the screen may be arranged in the inside or the outside of the electronic device 201. According to an embodiment of the present disclosure, the panel 262 may include a pressure sensor (or force sensor) that measures the intensity of touch pressure by a user. The pressure sensor may be implemented integrally with the touch panel 252, or may be implemented as at least one sensor separately from the touch panel 252. According to an embodiment of the present disclosure, the display 260 may further include a control circuit for controlling the panel 262, the hologram device 264, or the projector 266.

The interface 270 may include, for example, an HDMI 272, a USB 274, an optical interface 276, or a D-subminiature (D-sub) 278. The interface 270 may be included, for example, in the communication interface 170 illustrated in FIG. 1. Additionally or generally, the interface 270 may include, for example, a mobile high definition link (MHL)

interface, a SD card/multi-media card (MMC) interface, or an infrared data association (IrDA) standard interface.

The audio module 280 may convert a sound and an electric signal in dual directions. At least a part of the audio module 280 may be included, for example, in the input/output interface 150 illustrated in FIG. 1. The audio module 280 may process, for example, sound information that is input or output through a speaker 282, a receiver 284, an earphone 286, or the microphone 288.

For example, the camera module 291 may shoot a still image or a video. According to an embodiment of the present disclosure, the camera module 291 may include at least one or more image sensors (e.g., a front sensor or a rear sensor), a lens, an image signal processor (ISP), or a flash (e.g., an LED or a xenon lamp).

The power management module 295 may manage, for example, power of the electronic device 201. According to an embodiment of the present disclosure, a power management integrated circuit (PMIC), a charger IC, or a battery or fuel gauge may be included in the power management module 295. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, a rectifier, or the like. The battery gauge may measure, for example, a remaining capacity of the battery 296 and a voltage, current or temperature thereof while the battery is charged. The battery 296 may include, for example, a rechargeable battery and/or a solar battery.

The indicator 297 may display a specified state of the electronic device 201 or a part thereof (e.g., the processor 210), such as a booting state, a message state, a charging state, and the like. The motor 298 may convert an electrical signal into a mechanical vibration and may generate the following effects: vibration, haptic, and the like. Although not illustrated, a processing device (e.g., a graphic processing unit (GPU)) for supporting a mobile TV may be included in the electronic device 201. The processing device for supporting the mobile TV may process media data according to the standards of digital multimedia broadcasting (DMB), digital video broadcasting (DVB), MediaFLO™, or the like.

Each of the above-mentioned elements of the electronic device according to various embodiments described in this disclosure may be configured with one or more components, and the names of the elements may be changed according to the type of the electronic device. In various embodiments of the present disclosure, the electronic device may include at least one of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 3:
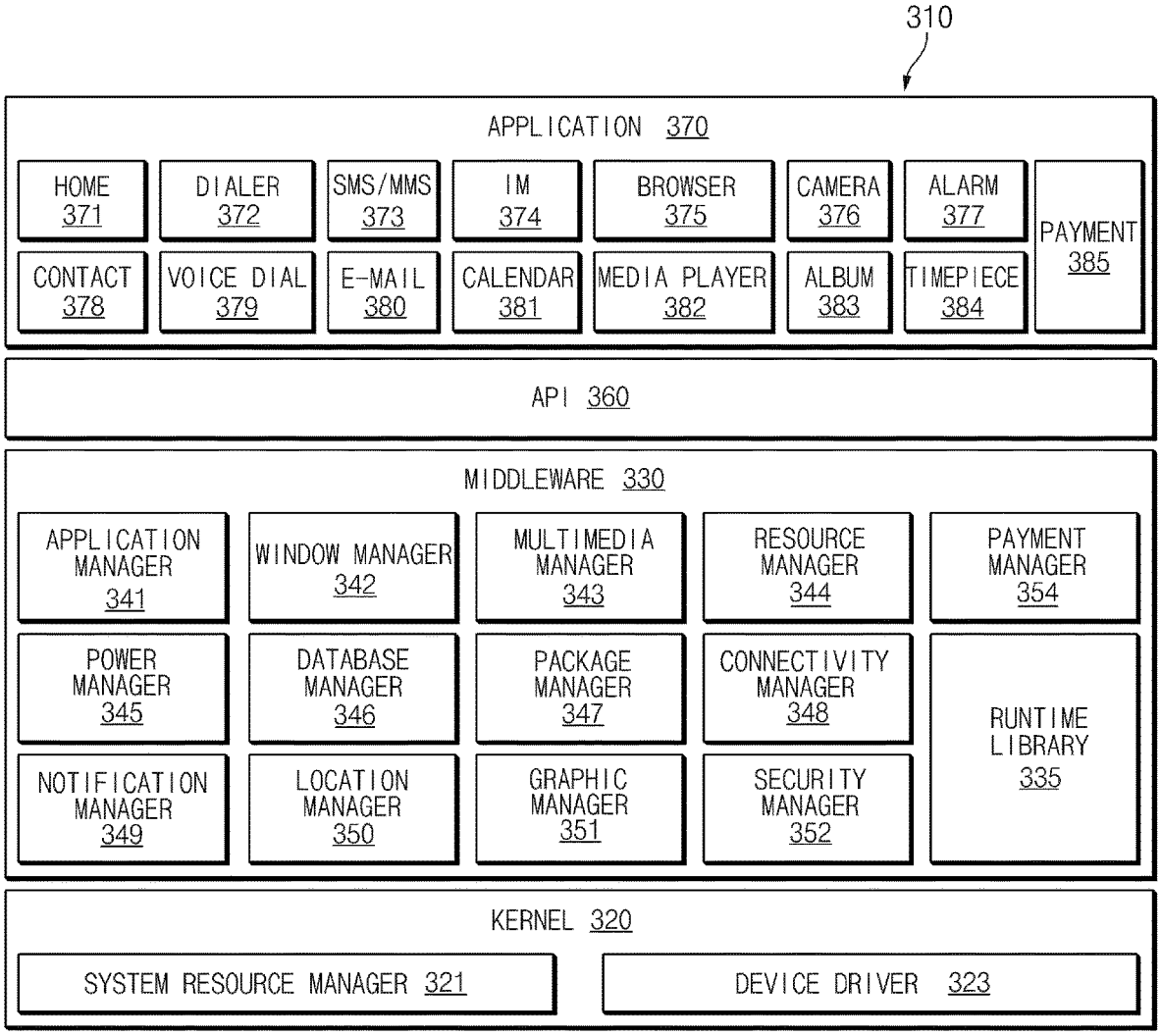
FIG. 3 illustrates a block diagram of a program module according to an embodiment of the present disclosure.

FIG. 3 illustrates a block diagram of a program module according to an embodiment of the present disclosure.

Referring to FIG. 3, a program module 310 (e.g., the program 140) may include an OS to control resources associated with an electronic device (e.g., the electronic device 101), and/or diverse applications (e.g., the application program 147) driven on the OS. The OS may be, for example, Android, iOS, Windows, Symbian, Tizen, or Samsung bada OS.

The program module 310 may include a kernel 320, a middleware 330, an API 360, and/or an application 370. At least a portion of the program module 310 may be preloaded on an electronic device or may be downloadable from an external electronic device (e.g., the electronic device 102 or 104, the server 106, or the like).

The kernel 320 (e.g., the kernel 141) may include, for example, a system resource manager 321 or a device driver 323. The system resource manager 321 may control, allocate, or retrieve system resources. According to an embodiment of the present disclosure, the system resource manager 321 may include a process managing unit, a memory managing unit, a file system managing unit, or the like. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

The middleware 330 may provide, for example, a function that the application 370 needs in common, or may provide diverse functions to the application 370 through the API 360 to allow the application 370 to efficiently use limited system resources of the electronic device. According to an embodiment of the present disclosure, the middleware 330 (e.g., the middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, a security manager 352, or a payment manager 354.

The runtime library 335 may include, for example, a library module that is used by a compiler to add a new function through a programming language while the application 370 is being executed. The runtime library 335 may perform input/output management, memory management, or capacities about arithmetic functions.

The application manager 341 may manage, for example, a life cycle of at least one application of the application 370. The window manager 342 may manage a graphic user interface (GUI) resource that is used in a screen. The multimedia manager 343 may identify a format necessary for playing diverse media files, and may perform encoding or decoding of media files by using a codec suitable for the format. The resource manager 344 may manage resources, such as a storage space, memory, or source code of at least one application of the application 370.

The power manager 345 may operate, for example, with a basic input/output system (BIOS) to manage a battery or power, and may provide power information for an operation of an electronic device. The database manager 346 may generate, search for, or modify database that is to be used in at least one application of the application 370. The package manager 347 may install or update an application that is distributed in the form of package file.

The connectivity manager 348 may manage, for example, wireless connection, such as Wi-Fi or BT. The notification manager 349 may display or notify an event, such as arrival message, appointment, or proximity notification in a mode that does not disturb a user. The location manager 350 may manage location information about an electronic device. The graphic manager 351 may manage a graphic effect that is provided to a user, or manage a user interface relevant thereto. The security manager 352 may provide a general security function necessary for system security, user authentication, or the like. According to an embodiment of the present disclosure, in the case where an electronic device (e.g., the electronic device 101) includes a telephony function, the middleware 330 may further include a telephony manager for managing a voice or video call function of the electronic device.

The middleware 330 may include a middleware module that combines diverse functions of the above-described elements. The middleware 330 may provide a module specialized to each OS kind to provide differentiated functions. Additionally, the middleware 330 may dynamically remove a part of the preexisting elements or may add new elements thereto.

The API 360 (e.g., the API 145) may be, for example, a set of programming functions and may be provided with a configuration that is variable depending on an OS. For example, in the case where an OS is the android or the iOS, it may provide one API set per platform. In the case where an OS is the Tizen, it may provide two or more API sets per platform.

The application 370 (e.g., the application program 147) may include, for example, one or more applications capable of providing functions for a home 371, a dialer 372, an short message service (SMS)/multi-media message service (MMS) 373, an instant message (IM) 374, a browser 375, a camera 376, an alarm 377, a contact 378, a voice dial 379, an e-mail 380, a calendar 381, a media player 382, an album 383, a timepiece 384, a payment 385, health care (e.g., measuring an exercise quantity, blood sugar, or the like) or offering of environment information (e.g., information of barometric pressure, humidity, temperature, or the like).

According to an embodiment of the present disclosure, the application 370 may include an application (hereinafter referred to as "information exchanging application" for descriptive convenience) to support information exchange between an electronic device (e.g., the electronic device 101) and an external electronic device (e.g., the electronic device 102 or 104). The information exchanging application may include, for example, a notification relay application for transmitting specified information to the external electronic device, or a device management application for managing the external electronic device.

For example, the notification relay application may include a function of transmitting notification information, which arise from other applications (e.g., applications for SMS/MMS, e-mail, health care, or environmental information), to an external electronic device (e.g., the electronic device 102 or 104). Additionally, the notification relay application may receive, for example, notification information from the external electronic device and provide the notification information to a user.

The device management application may manage (e.g., install, delete, or update), for example, at least one function (e.g., turn-on/turn-off of an external electronic device itself (or a part of components) or adjustment of brightness (or resolution) of a display) of the external electronic device (e.g., the electronic device 102 or 104) which communicates with the electronic device, an application running in the external electronic device, or a service (e.g., a call service, a message service, or the like) provided from the external electronic device.

According to an embodiment of the present disclosure, the application 370 may include an application (e.g., a health care application of a mobile medical device) that is assigned in accordance with an attribute of an external electronic device (e.g., the electronic device 102 or 104). According to an embodiment of the present disclosure, the application 370 may include an application that is received from the external electronic device (e.g., the server 106 or the electronic device 102 or 104). According to an embodiment of the present disclosure, the application 370 may include a preloaded application or a third party application that is downloadable from a server. The names of elements of the program module 310 according to the embodiment may be modifiable depending on kinds of operating systems.

According to various embodiments of the present disclosure, at least a portion of the program module 310 may be implemented by software, firmware, hardware, or a combination of two or more thereof. At least a portion of the program module 310 may be implemented (e.g., executed), for example, by the processor (e.g., the processor 210). At least a portion of the program module 310 may include, for example, modules, programs, routines, sets of instructions, processes, or the like for performing one or more functions.

Figure 4:
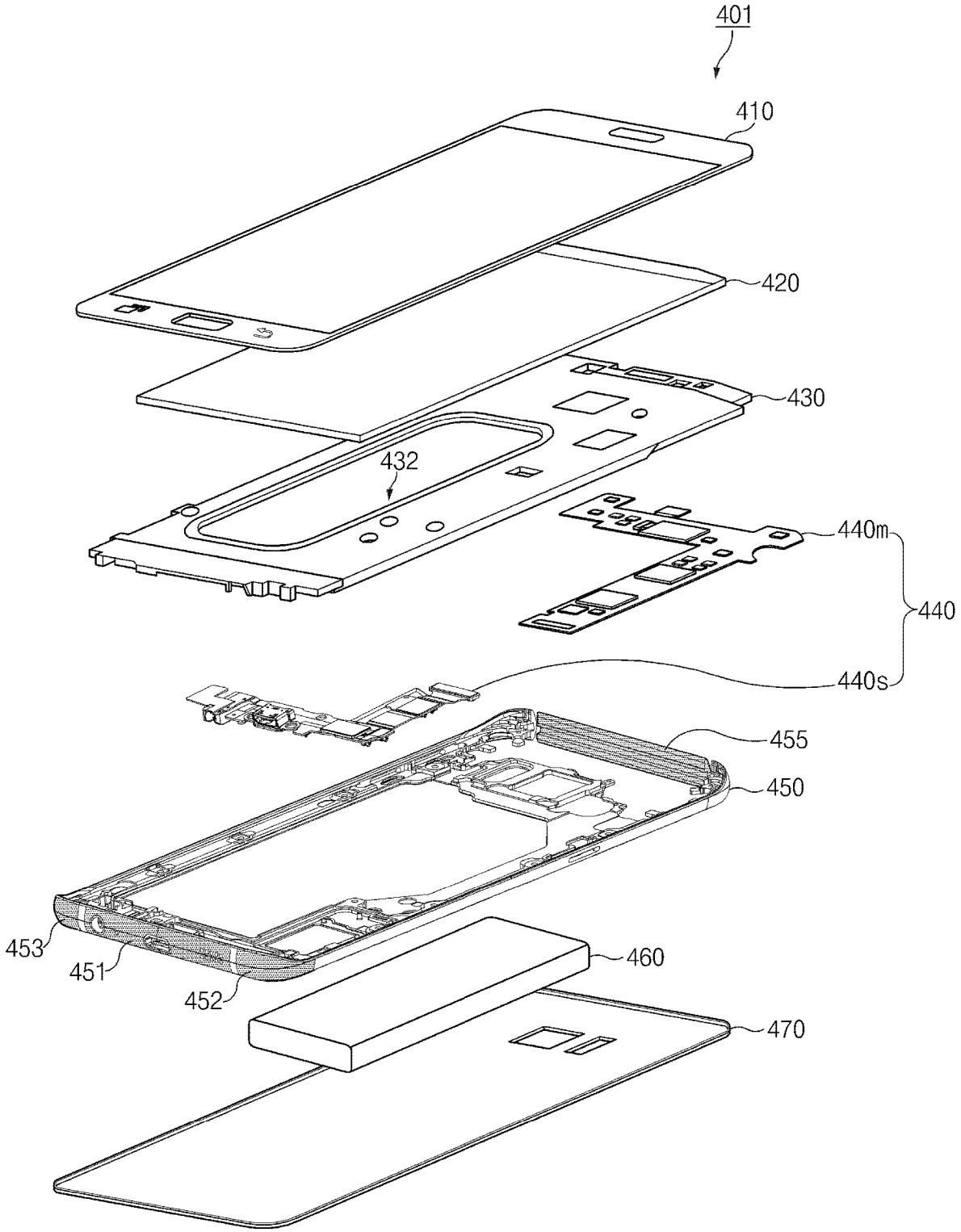
FIG. 4 illustrates an exploded perspective view of an electronic device according to an embodiment of the present disclosure.

FIG. 4 illustrates an exploded perspective view of an electronic device according to an embodiment of the present disclosure.

Referring to FIG. 4, an electronic device 401 according to an embodiment may include a cover glass 410, a display 420, a bracket 430, a circuit board 440, a rear housing 450, a battery 460, and/or a rear cover 470. According to various embodiments of the present disclosure, the electronic device 401 may be implemented without some of the elements illustrated in FIG. 4 or may be implemented to further include one or more elements not illustrated in FIG. 4.

The cover glass 410 may transmit light generated by the display 420. In addition, a user may touch a portion (e.g., a finger) of his/her body on the cover glass 410 to perform a touch (including a contact using an electronic pen). The cover glass 410 may be formed of, for example, tempered glass, reinforced plastic, a flexible polymer material, or the like and may protect the display 420 or each element included in the electronic device 401 from an external shock. According to various embodiments of the present disclosure, the cover glass 410 may be referred to as a glass window, and the cover glass 410 may constitute a front (first surface) housing of the electronic device 401.

The display 420 may be disposed or coupled below the cover glass 410 so as to be exposed through at least part of the cover glass 410 (front housing). The display 420 may output content (e.g., a text, an image, a video, an icon, a widget, a symbol, or the like) or may receive a touch input (including a touch, a hovering, and a "force touch") from the user. To this end, the display 420 may include a display panel, a touch panel, and/or a pressure sensor, for example. A thin film, a sheet, or a plate that is formed of copper (Cu) or graphite may be disposed on a rear surface of the display 420.

According to an embodiment of the present disclosure, the display panel of the display 420 may include LCD panel, LED display panel, an OLED display panel, a MEMS display panel, or an electronic paper display panel. In addition, the touch panel included in the display 420 may include, for example, a capacitive touch panel, a touch sensitive touch panel (or a resistive touch panel), an infrared touch panel, an ultrasonic touch panel, or the like.

The bracket 430 may be formed of, for example, magnesium alloy and may be disposed under the display 420 and over the circuit board 440. The bracket 430 may be coupled with the display 420 and the circuit board 440 to support the display 420 and the circuit board 440 physically. According to an embodiment of the present disclosure, a swelling gap 432 may be formed in the bracket 430 based on swelling of the battery 460 due to aged deterioration.

The circuit board 440 may include, for example, a main circuit board 440*m* or a sub circuit board 440*s*. According to an embodiment of the present disclosure, the main circuit board 440*m* and the sub circuit board 440*s* may be disposed below the bracket 430 and may be electrically connected to each other through a specified connector or a specified wiring. The circuit boards 440*m* and 440*s* may be implemented with a rigid printed circuit board (PCB), for example. According to an embodiment of the present disclosure, various electronic components, elements, and printed circuits (e.g., elements of FIGS. 1 and 2) of the electronic device 401 may be mounted or arranged on the circuit boards 440*m* and 440*s*. According to various embodiments of the present disclosure, the circuit boards 440*m* and 440*s* may be referred to as a "main board" or "printed board assembly (PBA)" or may be simply referred to as a "PCB."

The rear housing 450 may be disposed below the circuit board 440 and may accommodate each element of the electronic device 401. The rear housing 450 may form an outer appearance of a side surface of the electronic device 401. The rear housing 450 may be also referred to as a "rear case", a "rear plate", or the like. The rear housing 450 may include an area that is not exposed to the outside of the electronic device 401 and an area that is exposed through an outer side surface of the electronic device 401. For example, the area that is not exposed to the outside of the electronic device 401 may be formed of a plastic injection-molding material. The area that is exposed through the outer side surface of the electronic device 401 may be formed of metal. The exposed area of the outer side surface, which is formed of a metal material, may be also referred to as a "metal bezel."

According to an embodiment of the present disclosure, at least part of the metal bezel may be used as an antenna radiator for transmitting and receiving a signal of a specified frequency. For example, the antenna radiator may include antenna radiators 451, 452, and 453 disposed on a lower side and an antenna radiator 455 disposed on an upper side. The antenna radiators 451, 452, 453, and 455 may constitute part of a housing of the electronic device 401, which will be more fully described with reference to FIGS. 5, 6A, 6B, 7A, 7B, 7C, 9, 10, 11A, 11B, 12A and 12B.

The battery 460 may convert chemical energy and electrical energy bidirectionally. For example, the battery 460 may convert chemical energy into electrical energy and may supply the converted electrical energy to the display 420 and various elements or modules mounted on the circuit board 440. Alternatively, the battery 460 may convert and store electrical energy from the outside into chemical energy. According to an embodiment of the present disclosure, a power management module for managing charging and discharging of the battery 460 may be included in the circuit board 440.

The rear cover 470 may be coupled to a rear surface of the electronic device 401 (a second surface facing an opposite direction of the first surface). The rear cover 470 may be formed of tempered glass, a plastic injection-molding material, and/or metal. According to various embodiments of the present disclosure, the rear cover 470 may be integrated with the rear housing 450 or may be implemented to be removable by the user.

Figure 5:
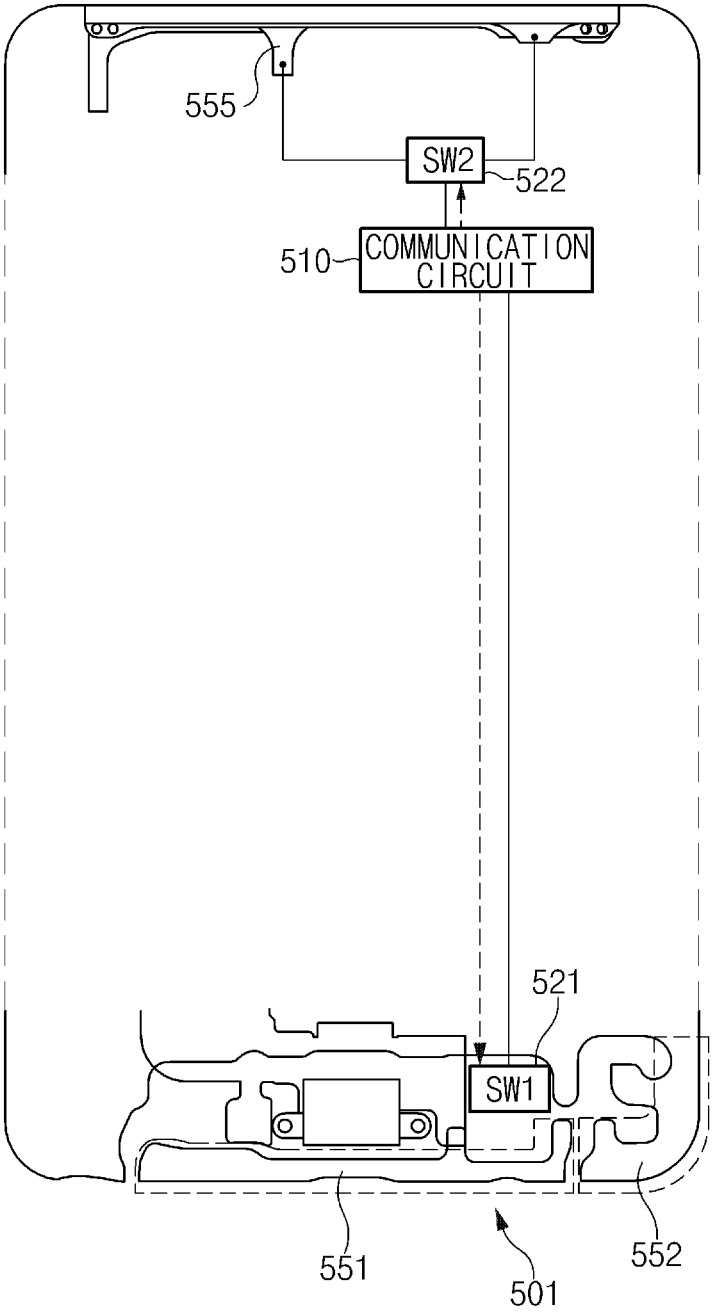
FIG. 5 is a view for describing an operation of an antenna according to an embodiment of the present disclosure.

FIG. 5 is a view for describing an operation of an antenna according to an embodiment of the present disclosure.

Referring to FIG. 5, an electronic device 501 may include a (wireless) communication circuit 510, a first switch (SW1) 521, a second switch (SW2) 522, a first antenna radiator 551, a second antenna radiator 552, and/or a third antenna radiator 555. For example, the first antenna radiator 551, the second antenna radiator 552, and the third antenna radiator 555 may be respectively included in the rear housing 450 illustrated in FIG. 4 or may respectively correspond to the antenna radiators 451, 452, and 455 constituting part of the rear housing 450.

According to an embodiment of the present disclosure, the first antenna radiator 551 and the second antenna radiator 552 may be disposed on a lower side of the electronic device 501. For example, the first antenna radiator 551 and/or the second antenna radiator 552 may be connected with the communication circuit 510 through the first switch 521. For example, an electrical length (e.g., a length of an antenna radiator needed for a communication signal to resonate at a specific frequency) of the first antenna radiator 551 may be designed to be longer than an electrical length of the second antenna radiator 552. A frequency band that resonates at the first antenna radiator 551 may be lower than a frequency band that resonates at the second antenna radiator 552.

According to an embodiment of the present disclosure, the third antenna radiator 555 may be disposed on an upper side of the electronic device 501. For example, the third antenna radiator 555 may be connected with the communication circuit 510 through the second switch 522.

According to an embodiment of the present disclosure, the communication circuit 510 may correspond to the communication interface 170 of FIG. 1 or the communication module 220 of FIG. 2. For example, the communication circuit 510 may include a CP or a controller circuit.

According to an embodiment of the present disclosure, the communication circuit 510 may provide a communication signal to the first antenna radiator 551 and/or the second antenna radiator 552 through the first switch 521. For example, the communication circuit 510 may feed the first antenna radiator 551 and/or the second antenna radiator 552 through the first switch 521.

According to an embodiment of the present disclosure, the communication circuit 510 may provide a communication signal to the third antenna radiator 555 through the second switch 522. For example, the communication circuit 510 may feed the third antenna radiator 555 through the second switch 522. In this specification, a partial node of the communication circuit 510 that is connected to an antenna radiator for feeding may be referred to as a "feeding unit."

According to an embodiment of the present disclosure, the communication circuit 510 may supply the first switch 521 with a first control signal for controlling the first switch 521. The communication circuit 510 may supply the second switch 522 with a second control signal for controlling the second switch 522. According to various embodiments of the present disclosure, the first switch 521 and/or the second switch 522 may be implemented with a switching circuit including a semiconductor device.

For example, the communication circuit 510 may sense (or measure) various parameters (e.g., a signal to noise ratio, a bits error ratio, energy per chip ratio (Ec/lo), a downlink (DL) data rate, received signal code power (RSCP), a received signal strength indicator (RSSI), or the like) that are used to determine the intensity or quality of a signal resonating at the first antenna radiator 551, the second antenna radiator 552, and/or the third antenna radiator 555 and may identify a frequency band of a signal (e.g., a weak electric field signal), the intensity or quality of which is sensed as being smaller than a specified value.

For example, in the case where the intensity of a signal received from a base station is small, there may be a need to improve the transmit/receive efficiency to maintain call quality. As radiation efficiency of an antenna is improved, the quality of communication (or quality of service (QoS))

may be maintained or improved even under the same weak electric field signal environment.

To transmit or receive a signal of an identified frequency band with the intensity larger than the specified value, the communication circuit 510 may supply the first control signal and/or the second control signal to the first switch 521 and/or the second switch 522, respectively. To transmit or receive the signal of the identified frequency band with the intensity larger than the specified value, the first switch 521 and/or the second switch 522 may electrically connect at least two or more of nodes included therein based on the control signal received from the communication circuit 510.

Below, an antenna radiator according to various embodiments will be described with reference to FIGS. 6A, 6B, 7A, 7B, 7C, 9, 10, 11A, 11B, 12A, and 12B. In FIGS. 6A, 6B, 7A, 7B, 7C, 8, 9, 10, 11A, 11B, 12A, and 12B, unless reference numerals are the same as each other, expressions "first", "second", "third", and the like may refer to different elements in drawings. For example, a "first antenna radiator" described in any drawing may refer to an element that is different from a "first antenna radiator" described in another drawing.

Figure 6A:
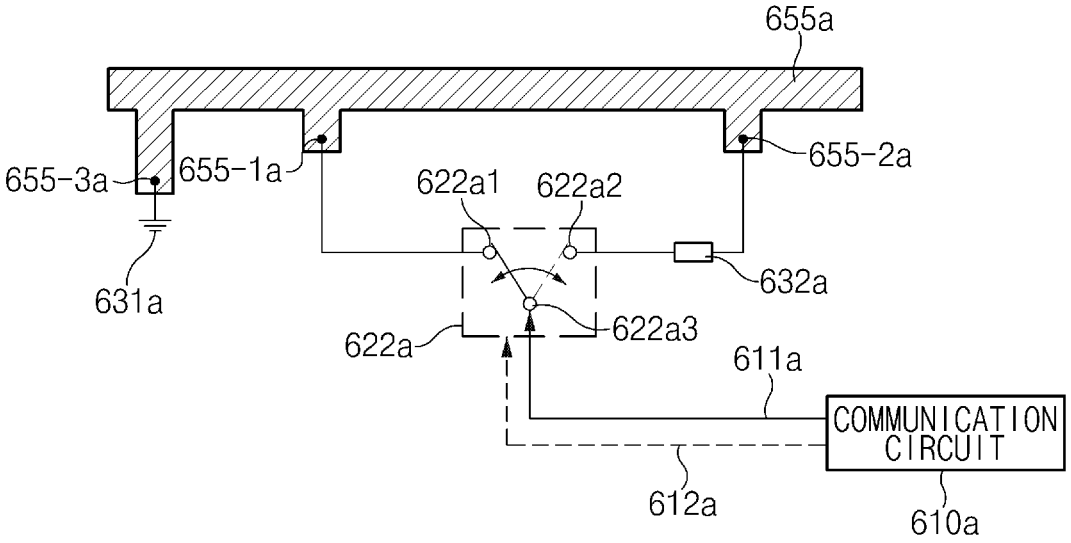
FIGS. 6A and 6B are views for describing an upper-side radiator according to various embodiments of the present disclosure.
Figure 6B:
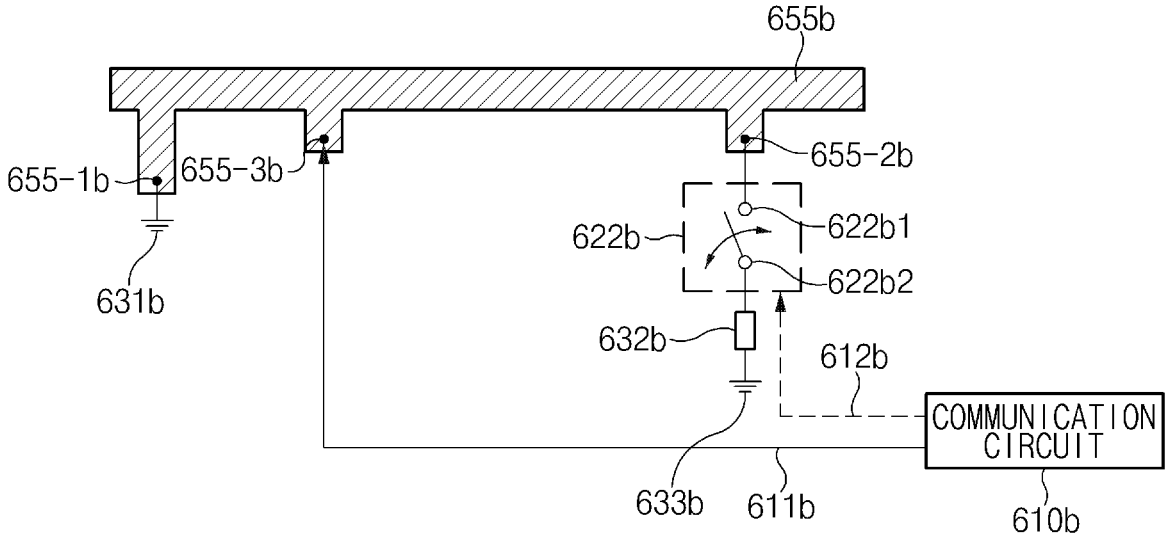

FIGS. 6A and 6B are views for describing an upper-side antenna radiator (third antenna radiator) according to various embodiments of the present disclosure.

Referring to FIG. 6A, a third antenna radiator 655*a* may be connected with a (wireless) communication circuit 610*a* through a second switch 622*a*. For example, the third antenna radiator 655*a* may correspond to the third antenna radiator 555 of FIG. 5, and the second switch 622*a* may correspond to the second switch 522 of FIG. 5.

According to an embodiment of the present disclosure, the third antenna radiator 655*a* may be connected with a first node (or a first port) 622*a*1 of the second switch 622*a* through a conductive line connected with a first position 655-1*a* and may be connected with a second node 622*a*2 of the second switch 622*a* through a conductive line connected with a second position 655-2*a*. The first position 655-1*a* and the second position 655-2*a* may be spaced apart from each other by a specified electrical length. According to various embodiments of the present disclosure, a lumped element 632*a* having a specified reactance value may be disposed on the conductive line connected with the second position 655-2*a* for frequency tuning. The third antenna radiator 655*a* may be electrically connected with a third ground 631*a* at a third position 655-3*a*.

According to an embodiment of the present disclosure, the second switch 622*a* may include the first node 622*a*1, the second node 622*a*2, and/or a third node 622*a*3 connected with the communication circuit 610*a* with a feeding line 611*a*. The third node 622*a*3 may be referred to as a "(second) feeding unit" in that the third node 622*a*3 is connected with the third antenna radiator 655*a* through the feeding line 611*a* to transmit and receive a wireless signal. In some embodiments of the present disclosure, a term "feeding unit" may be referred to as, but not limited to, "a feeding point," "a feeder," "a feeding device," or "an antenna feed."

According to an embodiment of the present disclosure, the second switch 622*a* may receive a second control signal from the communication circuit 610*a* through a control line 612*a*. In response to the second control signal, the second switch 622*a* may electrically connect the third node 622*a*3 (second feeding unit) and the first node 622*a*1 or may electrically connect the third node 622*a*3 (second feeding unit) and the second node 622*a*2.

For example, if the third node 622*a*3 (second feeding unit) and the first node 622*a*1 are electrically connected to each other, the third antenna radiator 655*a* may be fed through the first position 655-1*a*. If the third node 622*a*3 (second feeding unit) and the second node 622*a*2 are electrically connected to each other, the third antenna radiator 655*a* may be fed through the second position 655-2*a*.

Referring to FIG. 6B, a third antenna radiator 655*b* may be connected with a (wireless) communication circuit 610*b* through a second switch 622*b*. For example, the third antenna radiator 655*b* may correspond to the third antenna radiator 555 of FIG. 5, and the second switch 622*b* may correspond to the second switch 522 of FIG. 5.

According to an embodiment of the present disclosure, the third antenna radiator 655*b* may be electrically connected with a third ground 631*b* at a first position 655-1*b* and may be connected with a first node 622*b*1 of a second switch 622*b* through a conductive line connected with a second position 655-2*b*. The third antenna radiator 655*b* may be fed from the communication circuit 610*b* through a feeding line 611*b* at a third position 655-3*b*. The first position 655-1*b* and the second position 655-2*b* may be spaced apart from each other by a specified electrical length. The third position 655-3*b* may be referred to as a "(second) feeding unit" in that a wireless signal provided through the feeding line 611*b* is transmitted and received through the third antenna radiator 655*b* at the third position 655-3*b*.

According to an embodiment of the present disclosure, the second switch 622*b* may include the first node 622*b*1 and a second node 622*b*2 electrically connected with a fourth ground 633*b*. For example, the fourth ground 633*b* may be connected with the third antenna radiator 655*b* through the second switch 622*b* at the second position 655-2*b*. According to various embodiments of the present disclosure, a lumped element 632*b* having a specified reactance value may be disposed between the second node 622*b*2 and the fourth ground 633*b* for frequency tuning.

According to an embodiment of the present disclosure, the second switch 622*b* may receive a second control signal from the communication circuit 610*b* through a control line 612*b*. The second switch 622*b* may open or close in response to the second control signal. For example, if the second switch 622*b* opens, the second position 655-2*b* of the third antenna radiator 655*b* may open; if the second switch 622*b* closes, the second position 655-2*b* may be electrically connected with the fourth ground 633*b* through the lumped element 632*b*.

Figure 7A:
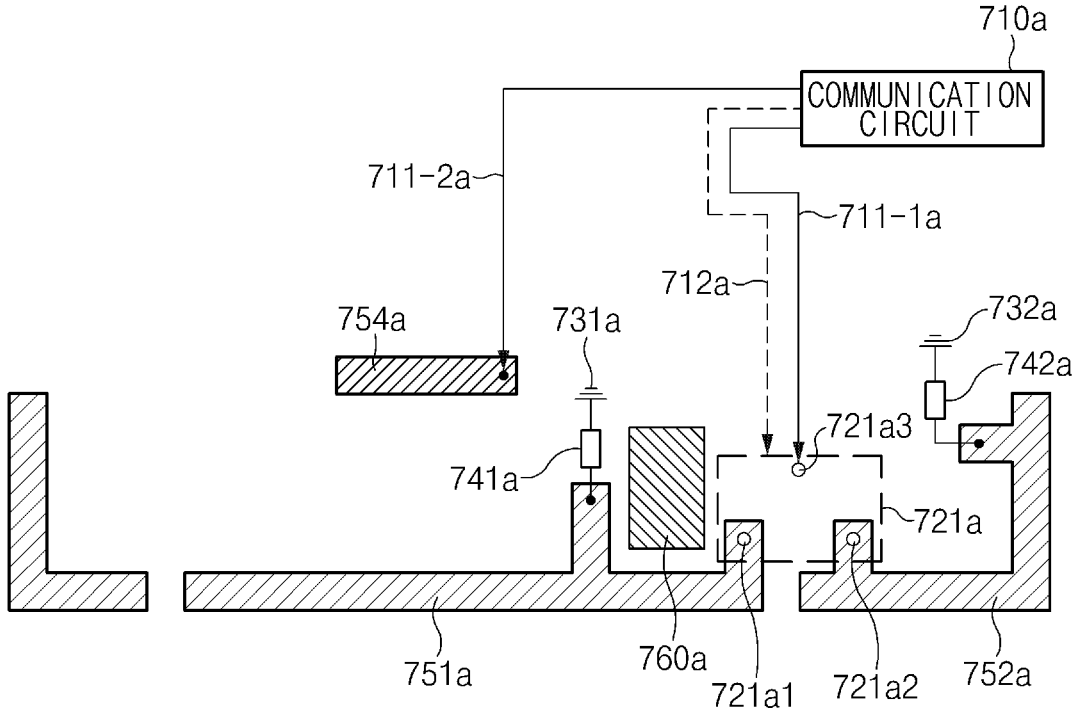
FIGS. 7A, 7B, and 7C are views for describing a lower-side antenna radiator according to various embodiments of the present disclosure.
Figure 7B:
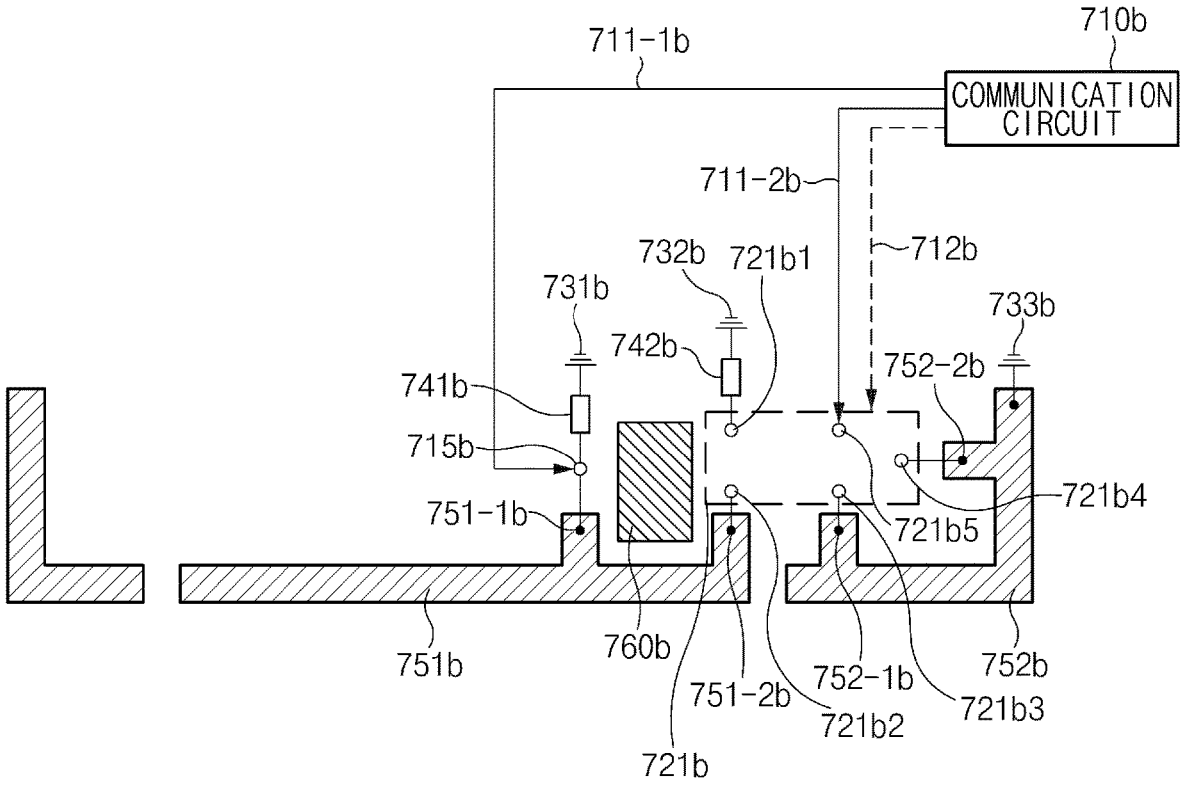
Figure 7C:
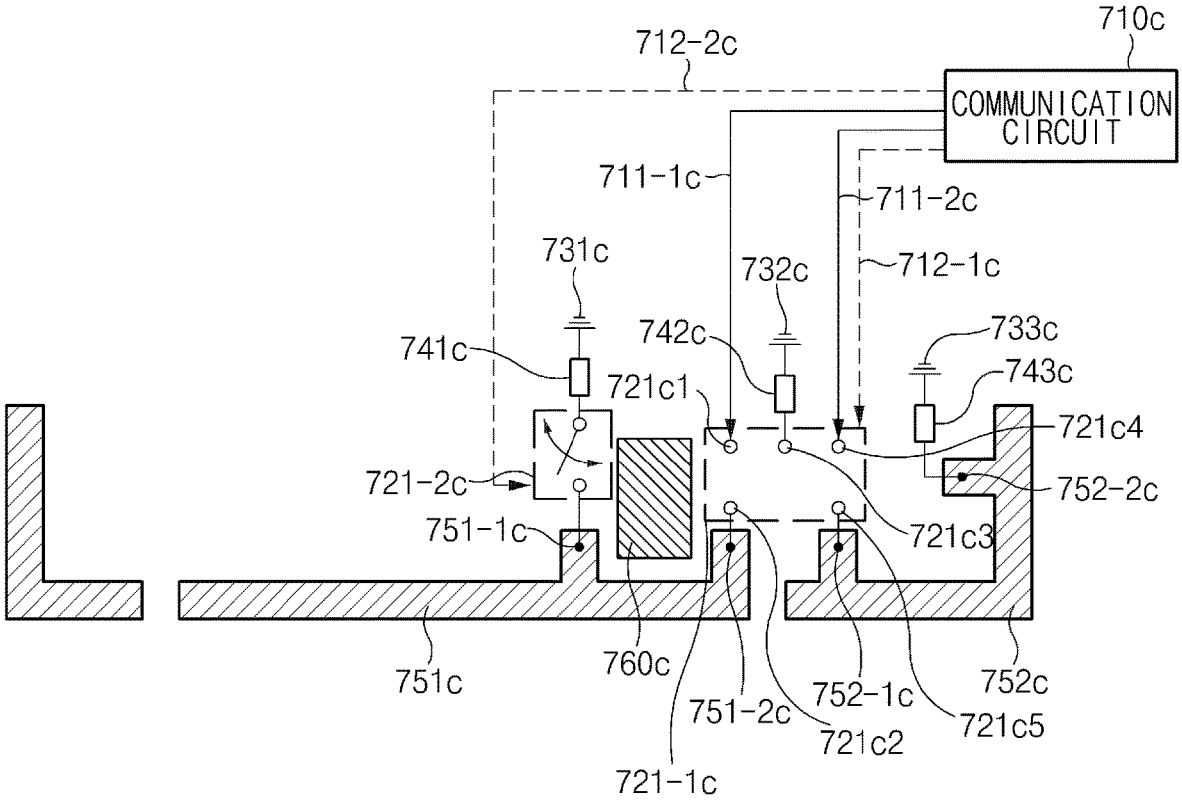

FIGS. 7A, 7B, and 7C are views for describing lower-side antenna radiators (first antenna radiator and second antenna radiator) according to various embodiments of the present disclosure.

Referring to FIG. 7A, a first antenna radiator 751*a* and a second antenna radiator 752*a* may be connected with a (wireless) communication circuit 710*a* through a first switch 721*a*. For example, the first antenna radiator 751*a* and the second antenna radiator 752*a* may respectively correspond to the first antenna radiator 551 and the second antenna radiator 552 of FIG. 5, and the first switch 721*a* may correspond to the first switch 521 of FIG. 5.

According to an embodiment of the present disclosure, the first antenna radiator 751*a* may be electrically connected with a first ground 731*a* through a conductive line connected at a position of the first antenna radiator 751*a*. The first antenna radiator 751*a* may include a first node 721*a*1 of the first switch 721*a*. According to various embodiments of the present disclosure, a lumped element 741*a* having a specified reactance value may be disposed on the conductive line for frequency tuning. For example, the first antenna radiator 751*a* may be adjacent to an earphone port 760*a*.

According to an embodiment of the present disclosure, the second antenna radiator 752*a* may be electrically connected with a second ground 732*a* through a conductive line connected at a position of the second antenna radiator 752*a*. The second antenna radiator 752*a* may include a second node 721*a*2 of the first switch 721*a*. According to various embodiments of the present disclosure, a lumped element 742*a* having a specified reactance value may be disposed on the conductive line for frequency tuning.

According to an embodiment of the present disclosure, the first switch 721*a* may include the first node 721*a*1, the second node 721*a*2, and/or a third node 721*a*3 connected with the communication circuit 710*a* with a feeding line 711-1*a*. The third node 721*a*3 may be referred to as a "feeding unit" in that the third node 721*a*3 transmits and receives a wireless signal through the feeding line 711-1*a* to and from the first antenna radiator 751*a* and/or the second antenna radiator 752*a*.

According to an embodiment of the present disclosure, the first switch 721*a* may receive a first control signal from the communication circuit 710*a* through a control line 712*a*. The first switch 721*a* may operate at three connection states to electrically connect the first antenna radiator 751*a*, the second antenna radiator 752*a*, and/or the third node 721*a*3 (feeding unit) in response to the first control signal.

For example, in response to the first control signal, the first switch 721*a* may operate at a first connection state to electrically connect the third node 721*a*3 (feeding unit) and the first node 721*a*1, a second connection state to electrically connect the third node 721*a*3 (feeding unit) and the second node 721*a*2, or a third connection state to connect the third node 721*a*3 (feeding unit), the first node 721*a*1, and the second node 721*a*2.

According to various embodiments of the present disclosure, if the third node 721*a*3 (feeding unit) and the first node 721*a*1 are electrically connected to each other, the first antenna radiator 751*a* may be fed. If the third node 721*a*3 (feeding unit) and the second node 721*a*2 are electrically connected to each other, the second antenna radiator 752*a* may be fed. If the third node 721*a*3 (feeding unit) and the first node 721*a*1 are electrically connected to each other and the third node 721*a*3 (feeding unit) and the second node 721*a*2 are electrically connected to each other, the first antenna radiator 751*a* and the second antenna radiator 752*a* may be fed at the same time.

According to various embodiments of the present disclosure, the communication circuit 710*a* may feed a fourth antenna radiator 754*a* through a feeding line 711-2*a*. For example, in the fourth antenna radiator 754*a*, a communication signal may resonate at a high frequency band (e.g., 5 to 6 GHz).

Referring to FIG. 7B, a first antenna radiator 751*b* and a second antenna radiator 752*b* may be connected with a (wireless) communication circuit 710*b* through a switch 721*b*. For example, the first antenna radiator 751*b* and the second antenna radiator 752*b* may correspond to the first antenna radiator 551 and the second antenna radiator 552 of FIG. 5, and the switch 721*b* may correspond to the first switch 521 of FIG. 5. For example, the first antenna radiator 751*b* may be adjacent to an earphone port 760*b*.

According to an embodiment of the present disclosure, the first antenna radiator 751*b* may be electrically connected with a first ground 731*b* through a conductive line connected to a position 751-1*b*. The first antenna radiator 751*b* may be electrically connected with a second node 721*b*2 of the switch 721*b* through a conductive line connected to another position 751-2*b*. According to various embodiments of the present disclosure, a lumped element 741*b* having a specified reactance value may be disposed on a conductive line drawn from the position 751-1*b*. A first feeding unit 715*b* that is electrically connected with the communication circuit 710*b* with a first feeding line 711-1*b* may be disposed on the conductive line connected from the position 751-1*b*.

According to an embodiment of the present disclosure, the second antenna radiator 752*b* may be electrically connected with a third node 721*b*3 of the switch 721*b* through a conductive line connected to a position 752-1*b*. The second antenna radiator 752*b* may be electrically connected with a fourth node 721*b*4 of the switch 721*b* through a conductive line connected to another position 752-2*b*. The second antenna radiator 752*b* may be electrically connected with a third ground 733*b*.

According to an embodiment of the present disclosure, the switch 721*b* may include a first node 721*b*1, the second node 721*b*2, the third node 721*b*3, the fourth node 721*b*4, and/or a fifth node 721*b*5. For example, the first node 721*b*1 may be connected with the second ground 732*b* through a lumped element 742*b*. The second ground 732*b* may be associated with the first antenna radiator 751*b*. According to various embodiments of the present disclosure, the fifth node 721*b*5 may be referred to as a "second feeding unit" in that the fifth node 721*b*5 transmits and receives a wireless signal through a second feeding line 711-2*b* to and from the first antenna radiator 751*b* and/or the second antenna radiator 752*b*.

According to an embodiment of the present disclosure, the switch 721*b* may receive a control signal from the communication circuit 710*b* through a control line 712*b*. In response to the control signal, the switch 721*b* may electrically connect at least two or more of the first antenna radiator 751*b* (e.g., the second node 721*b*2), the second antenna radiator 752*b* (e.g., the third node 721*b*3 and the fourth node 721*b*4), the second ground 732*b* (e.g., the first node 721*b*1), and the second feeding unit (e.g., the fifth node 721*b*5). A connection operation of the switch 721*b* according to various embodiments will be more fully described with reference to FIGS. 11A and 11B.

Referring to FIG. 7C, a first antenna radiator 751*c* and a second antenna radiator 752*c* may be connected with a (wireless) communication circuit 710*c* through a first switch 721-1*c*. For example, the first antenna radiator 751*c* and the second antenna radiator 752*c* may respectively correspond to the first antenna radiator 551 and the second antenna radiator 552 of FIG. 5, and the first switch 721-1*c* may correspond to the first switch 521 of FIG. 5. For example, the first antenna radiator 751*c* may be adjacent to an earphone port 760*c*.

According to an embodiment of the present disclosure, the first antenna radiator 751*c* may be electrically connected with a first ground 731*c* through a conductive line connected to a position 751-1*c*. The first antenna radiator 751*c* may be electrically connected with a second node 721*c*2 of the first switch 721-1*c* through a conductive line connected to another position 751-2*c*. According to various embodiments of the present disclosure, a lumped element 741*c* having a specified reactance value and a second switch 721-2*c* controlled by the communication circuit 710*c* may be disposed on the conductive line connected with the position 751-1*c*.

According to an embodiment of the present disclosure, the second antenna radiator 752*c* may be electrically connected with a fifth node 721*c*5 of the first switch 721-1*c* through a conductive line connected to a position 752-1*c*. The second antenna radiator 752*c* may be connected with a third ground 733*c* through a conductive line connected to another position 752-2*c*. According to various embodiments of the present disclosure, a lumped element 743*c* having a specified reactance value may be disposed on a conductive line connected to the position 752-2*c*.

According to an embodiment of the present disclosure, the first switch 721-1*c* may include the first node 721*c*1, the second node 721*c*2, the third node 721*c*3, the fourth node 721*c*4, and/or the fifth node 721*c*5. For example, the first node 721*c*1 and the fourth node 721*c*4 may be respectively referred to as a "first feeding unit" and a "second feeding unit" in that the first node 721*c*1 and the fourth node 721*c*4 transmit and receive wireless signals through a first feeding line 711-1*c* and a second feeding line 711-2*c* to and from the first antenna radiator 751*c* and/or the second antenna radiator 752*c*. For example, the third node 721*c*3 may be connected with a second ground 732*c* through a lumped element 742*c*. The second ground 732*c* may be associated with the first antenna radiator 751*c*.

According to an embodiment of the present disclosure, the first switch 721-1*c* may receive a first control signal from the communication circuit 710*c* through a control line 712-1*c*. In response to the first control signal, the first switch 721-1*c* may electrically connect at least two or more of the first feeding unit (e.g., the first node 721*c*1), the second feeding unit (e.g., the fourth node 721*c*4), the first antenna radiator (e.g., the second node 721*c*2), the second antenna radiator (e.g., the fifth node 721*c*5), and the second ground (e.g., the third node 721*c*3). A connection operation of the switch 721-1*c* according to various embodiments will be more fully described with reference to FIGS. 12A and 12B.

According to an embodiment of the present disclosure, the second switch 721-2*c* may receive a second control signal from the communication circuit 710*c* through a control line 712-2*c*. The switch 721-2*c* may open or close in response to the second control signal.

Figure 8:
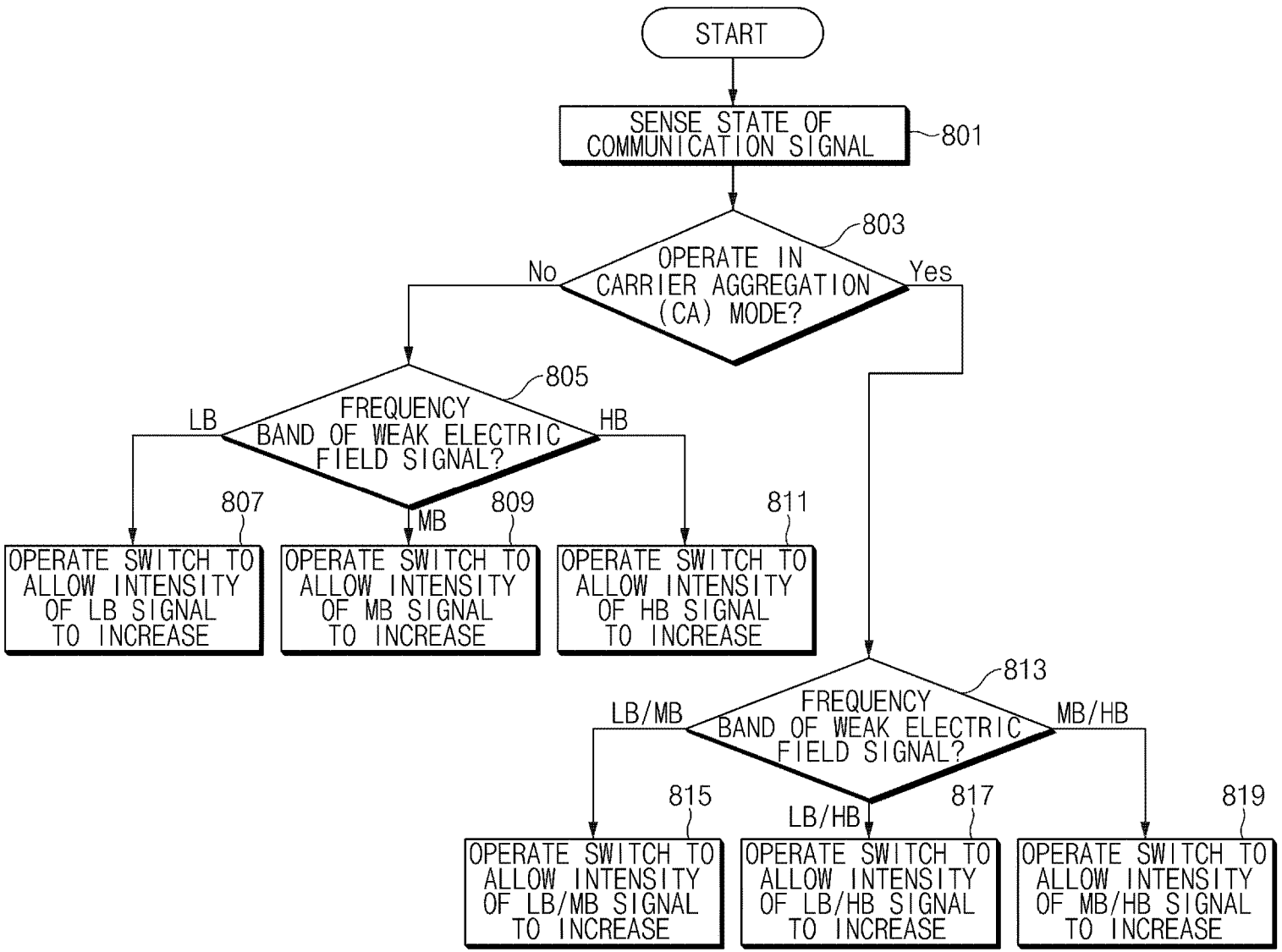
FIG. 8 is a flowchart for describing an operation of a communication circuit according to an embodiment of the present disclosure.

FIG. 8 is a flowchart for describing an operation of a communication circuit according to an embodiment of the present disclosure.

Referring to FIG. 8, an operation of a communication circuit according to an embodiment may include operation 801 to operation 819. Operation 801 to operation 819 may be executed by, for example, the communication interface 170 illustrated in FIG. 1, the communication module 220 illustrated in FIG. 2, and the communication circuit 510 (a CP or a control circuit included in the communication circuit 510) illustrated in FIG. 5. For example, operation 801 to operation 819 may be respectively implemented with instructions that are capable of being stored in a computer-readable recording medium or a memory, for example.

In operation 801, the communication circuit may sense (or measure) a state of a communication signal transmitted and received through an antenna periodically or non-periodically. For example, the communication circuit may sense (or measure) various parameters (e.g., a signal to noise ratio, a bits error ratio, energy per chip ratio (Ec/lo), a DL data rate, RSCP, a RSSI, or the like) that are used to determine the intensity or quality of a signal transmitted and received through a plurality of antenna radiators (e.g., a first antenna radiator and a second antenna radiator).

In operation 803, the communication circuit (or a CP) may determine whether the communication circuit operates in a carrier aggregation (CA) mode. If it is determined in operation 713 that the communication circuit operates in a CA mode, the procedure may proceed to operation 813. Otherwise, the procedure may proceed to operation 805.

In operation 805, the communication circuit may identify a frequency band of a weak electric field signal. For example, the communication circuit may identify a frequency band of a wireless signal (e.g., a weak electric field signal) being transmitted and received by using the various parameters that indicate the intensity or quality of a signal. In the case where the weak electric field signal includes at least part of a low-band (LB) (first frequency band), the communication circuit may proceed to operation 807. In the case where the weak electric field signal includes at least part of a mid-band (MB) (second frequency band), the communication circuit may proceed to operation 809. In the case where the weak electric field signal includes at least part of a high-band (HB) (third frequency band), the communication circuit may proceed to operation 811.

According to an embodiment of the present disclosure, the low-band (first frequency band) may include a frequency band of 600 to 990 MHz. The mid-band (second frequency band) may include a frequency band of 1400 to 2200 MHz. The high-band (third frequency band) may include a frequency band of 2200 to 2700 MHz.

In operation 807, operation 809, and operation 811, the communication circuit may provide a specified control signal to a switch(s) for improving signal intensity or quality of a weak electric field signal identified in operation 805. For example, if the frequency band of the identified weak electric field signal is included in the low-band, then the communication circuit, in operation 807, may provide a specified control signal to a switch(s) for improving the identified weak electric field signal. Similar operation may be applicable in operation 809 and operation 811. The switch(s) may perform various switch open/close operations in response to the specified control signal.

In operation 813, the communication circuit may operate in the CA mode in which wide band communication is performed using different frequency bands. The communication circuit may identify a frequency band(s) corresponding to a weak electric field signal. For example, the communication circuit may identify the frequency band(s) the weak electric field signal being transmitted and received by using the various parameters that indicate the intensity or quality of a signal.

If the identified frequency band(s) of the weak electric field signal includes at least part of the LB (first frequency band) and/or the MB, the communication circuit may proceed to operation 815. If the identified frequency band(s) of the weak electric field signal includes at least part of the LB (first frequency band) and/or the HB, the communication circuit may proceed to operation 817. If the identified frequency band(s) of the weak electric field signal includes at least part of the MB (first frequency band) and/or the HB, the communication circuit may proceed to operation 819.

In operation 815, the communication circuit may provide a specified control signal to a switch(s) for improving signal intensity or quality of a weak electric field signal having at least part of the LB (first frequency band) and/or the MB (second frequency band). The switch(s) may perform various switch open/clock operations in response to the specified control signal.

In operation 817, the communication circuit may provide a specified control signal to a switch(s) for improving signal intensity or quality of a weak electric field signal having at least part of the LB (first frequency band) and/or the HB (third frequency band). The switch(s) may perform various switch open/close operations in response to the specified control signal.

In operation 819, the communication circuit may provide a specified control signal to a switch(s) for improving signal intensity or quality of a weak electric field signal having at least part of the MB (second frequency band) and/or the HB (third frequency band). The switch(s) may perform various switch open/close operations in response to the specified control signal.

Figure 9:
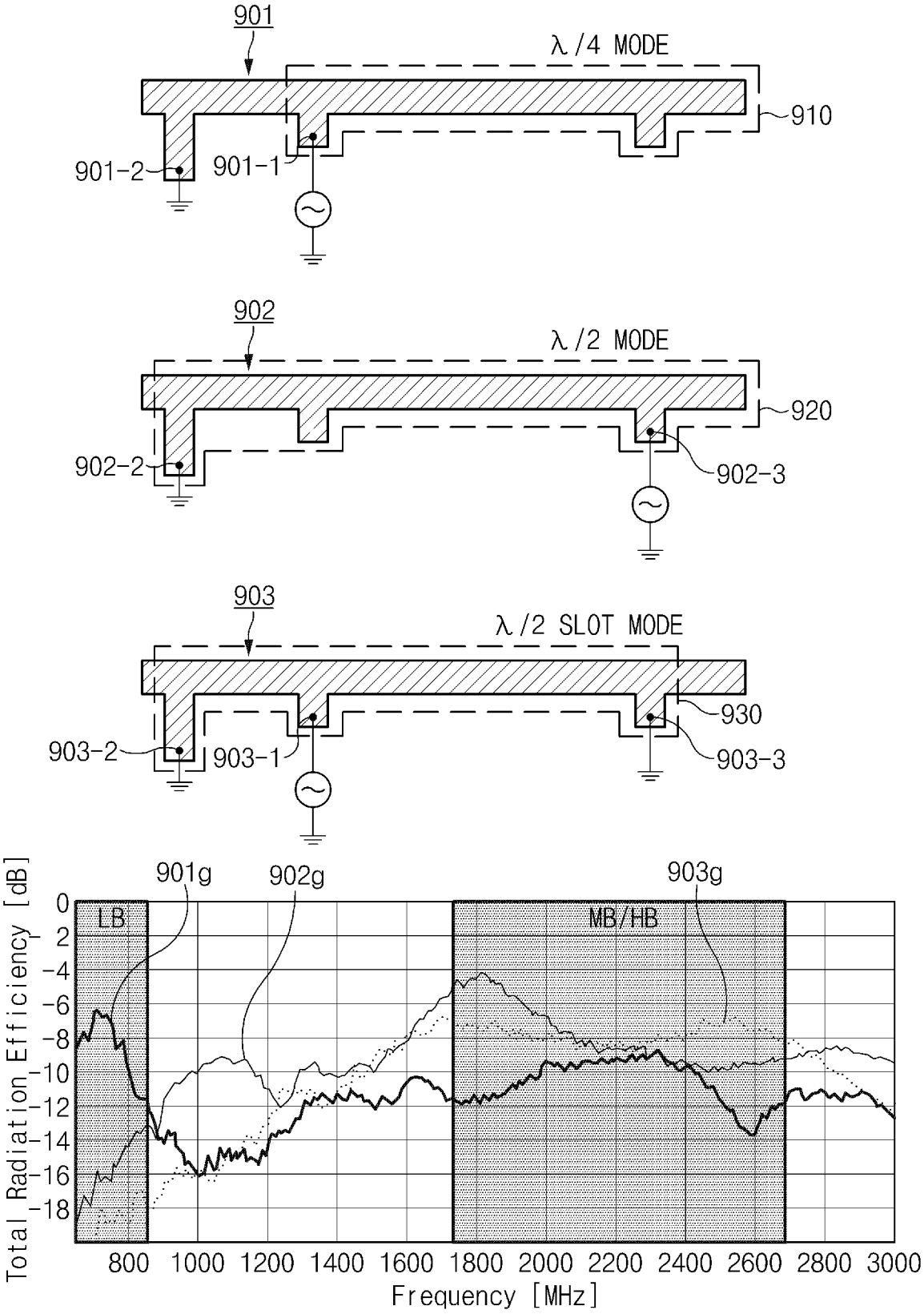
FIG. 9 is a view for describing radiation performance of a upper-side antenna radiator according to an embodiment of the present disclosure.

FIG. 9 is a view for describing radiation performance of an upper-side antenna radiator according to an embodiment of the present disclosure.

Referring to FIG. 9, upper-side antenna radiators (third antenna radiators) 901, 902, and 903 according to various embodiments are illustrated. Each of the upper-side antenna radiators 901, 902, and 903 may correspond to the third antenna radiator 655*a* illustrated in FIG. 6A or the third antenna radiator 655*b* illustrated in FIG. 6B.

According to an embodiment of the present disclosure, the third antenna radiator 901 may be fed at a first position 901-1. A ground may be disposed at a second position 901-2 of the third antenna radiator 901. For example, a position of a feeding unit of the third antenna radiator 901 and a position of the ground of the third antenna radiator 901 may correspond to the case where the first node 622*a*1 and the third node 622*a*3 of the second switch 622*a* illustrated in 6A are connected to each other or the case where the second switch 622*b* illustrated in FIG. 6B opens.

According to an embodiment of the present disclosure, if the third antenna radiator 901 is fed at the first position 901-2 and is grounded at the second position 901-2, resonance may occur at a partial area 910, which has an electrical length of λ/4 of a wavelength corresponding to a resonant frequency, of the third antenna radiator 901. For example, the third antenna radiator 901 may constitute an inverted-F antenna. The remaining portion of the third antenna radiator 901 other than the partial area 910 may be used for frequency tuning (e.g., impedance matching).

According to an embodiment of the present disclosure, the third antenna radiator 902 may be fed at a third position 902-3. A ground may be disposed at a second position 902-2 of the third antenna radiator 902. For example, a position of a feeding unit of the third antenna radiator 902 and a position of the ground of the third antenna radiator 902 may correspond to the case where the second node 622*a*2 and the third node 622*a*3 of the second switch 622*a* illustrated in 6A are connected to each other.

According to an embodiment of the present disclosure, if the third antenna radiator 902 is fed at the third position 902-3 and is grounded at the second position 902-2, resonance may occur at a partial area 920, which has an electrical length of λ/2 of a wavelength corresponding to a resonant frequency, of the third antenna radiator 902.

According to an embodiment of the present disclosure, the third antenna radiator 903 may be fed at a first position 903-1. A ground may be disposed at a second position 903-2 and a third position 903-3 of the third antenna radiator 903. For example, a position of a feeding unit of the third antenna radiator 903 and a position of the ground of the third antenna radiator 903 may correspond to the case where the second switch 622*b* illustrated in FIG. 6B closes.

According to an embodiment of the present disclosure, if the third antenna radiator 903 is fed at the first position 903-1 and is grounded at the second position 903-2, resonance may occur at a partial area 930, which has an electrical length of λ/2 of a wavelength corresponding to a resonant frequency, of the third antenna radiator 903 (λ/2 slot mode).

Radiation efficiency curves 901*g*, 902*g*, and 903*g* that correspond to frequencies of the third antenna radiators 901, 902, and 903 are illustrated in FIG. 9. In a graph where the radiation efficiency curves 901*g*, 902*g*, and 903*g* are illustrated, a horizontal axis represents a frequency (MHz), and a vertical axis represents radiation efficiency (dB).

Referring to the radiation efficiency curve 901*g*, the third antenna radiator 901 that operates in a λ/4 mode shows radiation efficiency higher than other curves in a LB. According to various embodiments of the present disclosure, if it is determined that there is received a signal of the (LB, the intensity of which is smaller than a specified value, to transmit or receive the signal of the LB with the intensity larger than the specified value, the communication circuit may supply a switch with a control signal for configuring an antenna radiator like the third antenna radiator 901 (refer to operation 807 of FIG. 8).

For example, if it is determined that the signal of the LB corresponds to a weak electric field signal, the communication circuit 610*a* illustrated in FIG. 6A may generate a control signal allowing the second switch 622*a* to connect the first node 622*a*1 and the third node 622*a*3 and may supply the control signal to the second switch 622*a*. For another example, if it is determined that the signal of the LB corresponds to a weak electric field signal, the communication circuit 610*b* illustrated in FIG. 6B may generate a control signal allowing the second switch 622*b* to open and may supply the control signal to the second switch 622*b*.

Referring to the radiation efficiency curve 902*g*, the third antenna radiator 902 that operates in a λ/2 mode shows radiation efficiency higher than other curves in a MB. According to various embodiments of the present disclosure, if it is determined that there is received a signal of the MB, the intensity of which is smaller than a specified value, to transmit or receive the signal of the MB with the intensity larger than the specified value, the communication circuit may configure an antenna radiator like the third antenna radiator 902. To this end, the communication circuit may supply a switch with a control signal for configuring the antenna radiator like the third antenna radiator 902 (refer to operation 809 of FIG. 8).

For example, if it is determined that the signal of the MB corresponds to a weak electric field signal, the communication circuit 610*a* illustrated in FIG. 6A may generate a control signal allowing the second switch 622*a* to connect the second node 622*a*2 and the third node 622*a*3 and may supply the control signal to the second switch 622*a*.

Referring to the radiation efficiency curve 903*g*, the third antenna radiator 903 that operates in a λ/2 slot mode shows radiation efficiency higher than other curves in a HB. Accordingly, if it is determined that there is received a signal of the HB, the intensity of which is smaller than a specified value, to transmit or receive the signal of the HB with the intensity larger than the specified value, the communication circuit may supply a switch with a control signal for configuring an antenna radiator like the third antenna radiator 903 (refer to operation 811 of FIG. 8).

For example, if it is determined that the signal of the HB corresponds to a weak electric field signal, the communication circuit 610*b* illustrated in FIG. 6B may generate a control signal allowing the second switch 622*b* to close and may supply the control signal to the second switch 622*b*.

Figure 10:
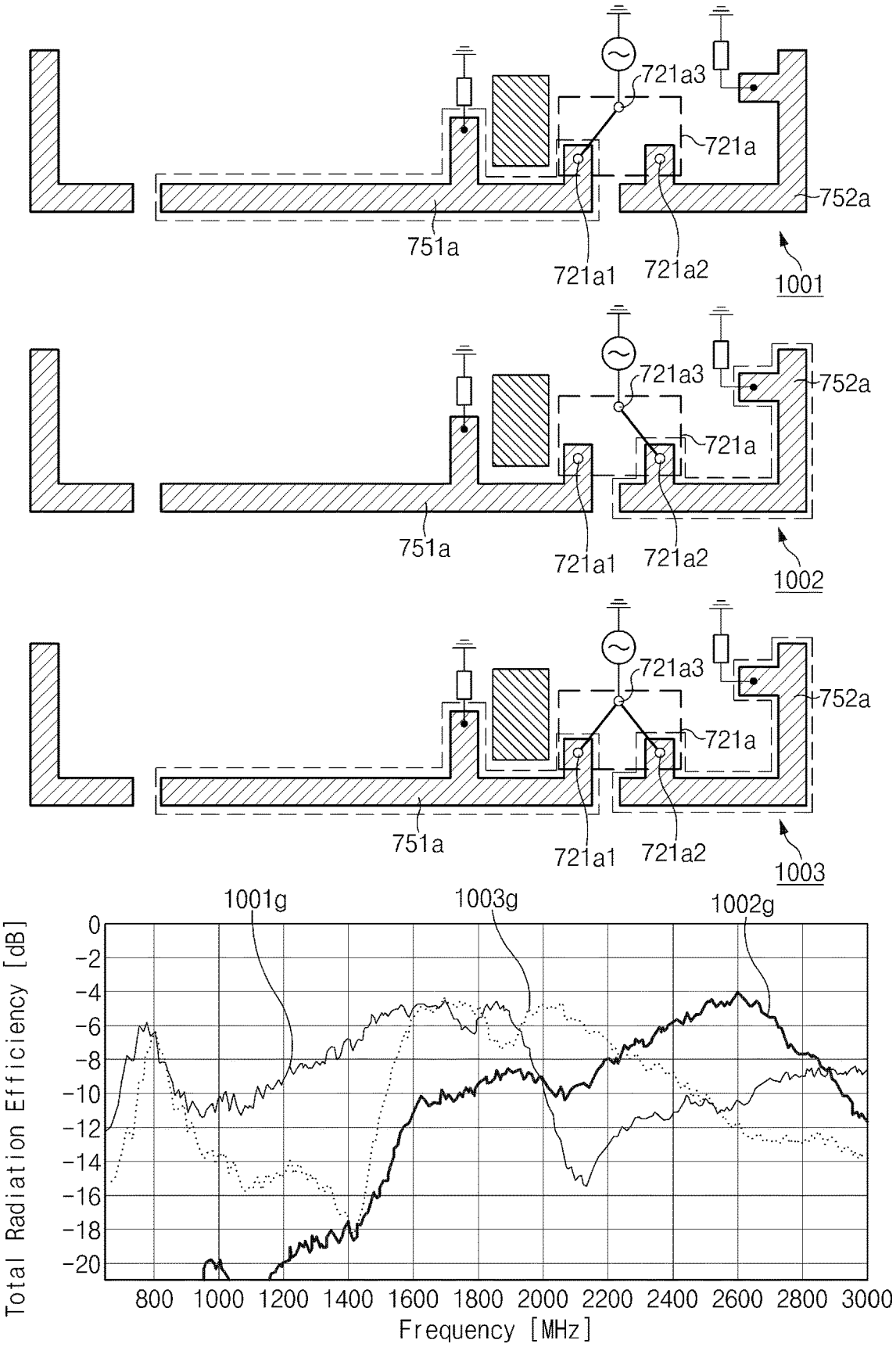
FIG. 10 is a view for describing radiation performance of a lower-side antenna radiator according to an embodiment of the present disclosure.

FIG. 10 is a view for describing radiation performance of lower-side antenna radiators according to an embodiment of the present disclosure.

Referring to FIG. 10, lower-side antenna radiators 1001, 1002, and 1003 each including a first antenna radiator and a second antenna radiator according to various embodiments are illustrated. Each of the lower-side antenna radiators 1001, 1002, and 1003 may include the first antenna radiator 751*a* and the second antenna radiator 752*a* illustrated in FIG. 7A. Below, reference numerals of FIG. 7A will be used for convenience of description.

In the lower-side antenna radiator 1001 according to an embodiment of the present disclosure, a first node 721*a*1 and a third node 721*a*3 of a first switch 721*a* may be electrically connected to each other. The first antenna radiator 751*a* may be fed through the first node 721*a*1.

In the lower-side antenna radiator 1002 according to an embodiment of the present disclosure, a second node 721*a*2 and the third node 721*a*3 of the first switch 721*a* may be electrically connected to each other. The second antenna radiator 752*a* may be fed through the second node 721*a*2.

In the lower-side antenna radiator 1003 according to an embodiment of the present disclosure, the first node 721*a*1 and the third node 721*a*3 of the first switch 721*a* may be electrically connected to each other, and the second node 721*a*2 and the third node 721*a*3 thereof may be electrically connected to each other. The first antenna radiator 751*a* and the second antenna radiator 752*a* may be fed through the first node 721*a*1 and the second node 721*a*2.

Radiation efficiency curves 1001*g*, 1002*g*, and 1003*g* that correspond to frequencies of the lower-side antenna radiators 1001, 1002, and 1003 are illustrated in FIG. 10. In a graph where the radiation efficiency curves 1001*g*, 1002*g*, and 1003*g* are illustrated, a horizontal axis represents a frequency (MHz), and a vertical axis represents radiation efficiency (dB).

Referring to the radiation efficiency curve 1001*g*, the lower-side antenna radiator 1001 shows relatively high radiation efficiency in the LB and the MB. According to various embodiments of the present disclosure, if it is determined that there is received a signal of the LB and/or the 1\4B, the intensity of which is smaller than a specified value, the communication circuit may supply a switch with a control signal for configuring a lower-side antenna radiator as the lower-side antenna radiator 1001 (refer to operations 807, 809, and 815 of FIG. 8) in order to improve the intensity of the signal of the LB and/or the MB.

For example, if it is determined that the signal of the LB or the MB corresponds to a weak electric field signal, the communication circuit 710*a* illustrated in FIG. 7A may generate a control signal allowing the first switch 721*a* to connect the first node 721*a*1 and the third node 721*a*3 and may supply the control signal to the first switch 721*a*.

Referring to the radiation efficiency curve 1002*g*, the lower-side antenna radiator 1002 shows relatively high radiation efficiency in the HB. Accordingly, if it is determined that there is received a signal of the HB, the intensity of which is smaller than a specified value, the communication circuit may supply a switch with a control signal for configuring a lower-side antenna radiator as the lower-side antenna radiator 1002 in order to improve the intensity of the signal of the HB (refer to operation 817 of FIG. 8).

For example, if it is determined that the signal of the HB corresponds to a weak electric field signal, the communication circuit 710*a* illustrated in FIG. 7A may generate a control signal allowing the first switch 721*a* to connect the second node 721*a*2 and the third node 721*a*3 and may supply the control signal to the first switch 721*a*.

Referring to the radiation efficiency curve 1003*g*, the lower-side antenna radiator 1003 shows relatively high radiation efficiency in the LB and/or the HB. According to various embodiments of the present disclosure, if it is determined that there is received a signal of the LB and/or the HB, the intensity of which is smaller than a specified value, or in the case of CA of the LB and the HB, the communication circuit may supply a switch with a control signal for configuring a lower-side antenna radiator as the lower-side antenna radiator 1003 (refer to operation 819 of FIG. 8).

For example, if it is determined that there is received a LB and/or HB signal, the intensity of which is smaller than a specified value; or in the case of performing CA of the LB and the HB, the communication circuit 710*a* illustrated in FIG. 7A may generate a control signal allowing the first switch 721*a* to connect the first node 721*a*1 and the third node 721*a*3 and to connect the second node 721*a*2 and the third node 721*a*3 and may supply the control signal to the first switch 721*a*.

Figure 11A:
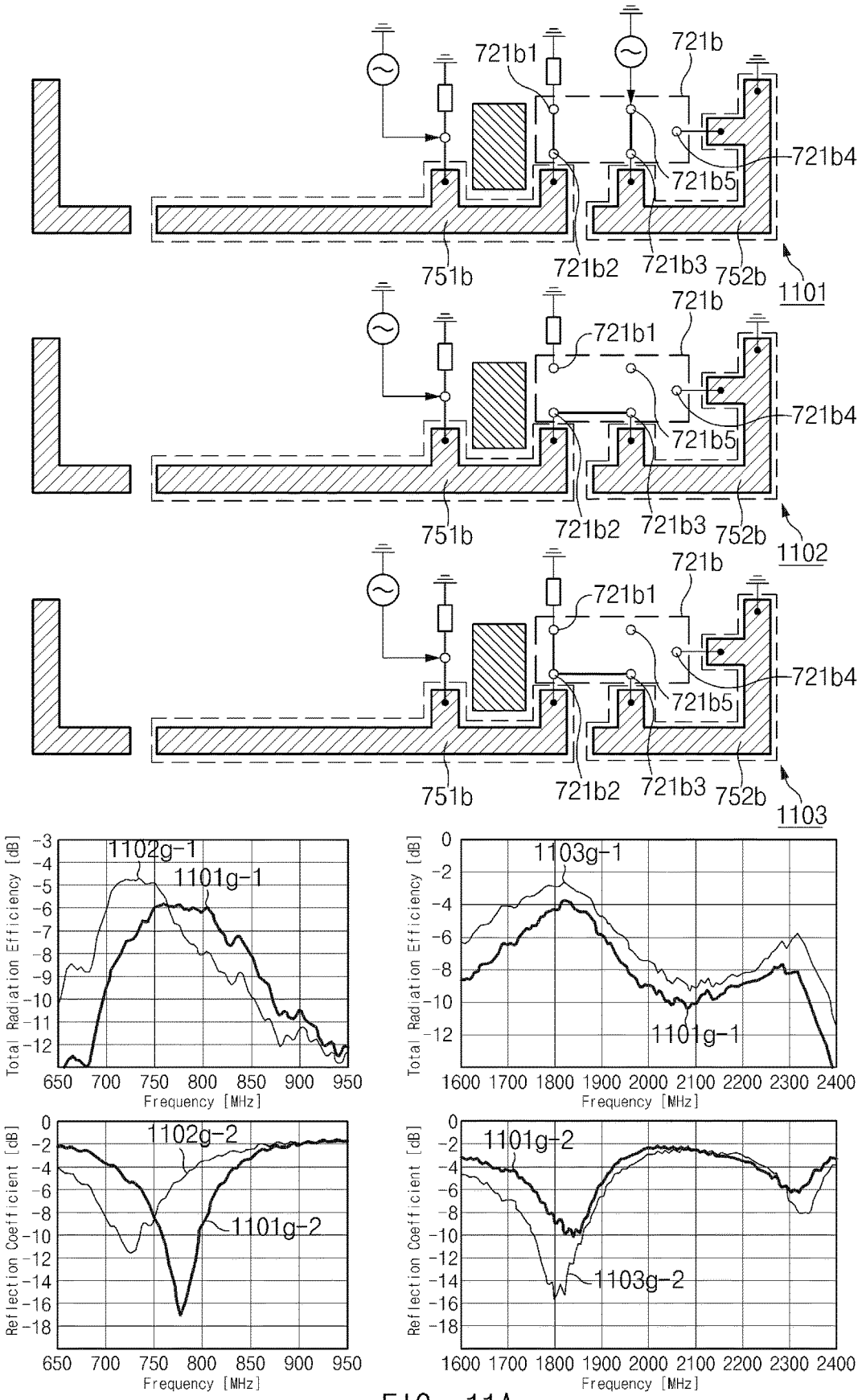
FIG. 11A is a view for describing radiation performance of a lower-side antenna radiator according to an embodiment of the present disclosure.
Figure 11B:
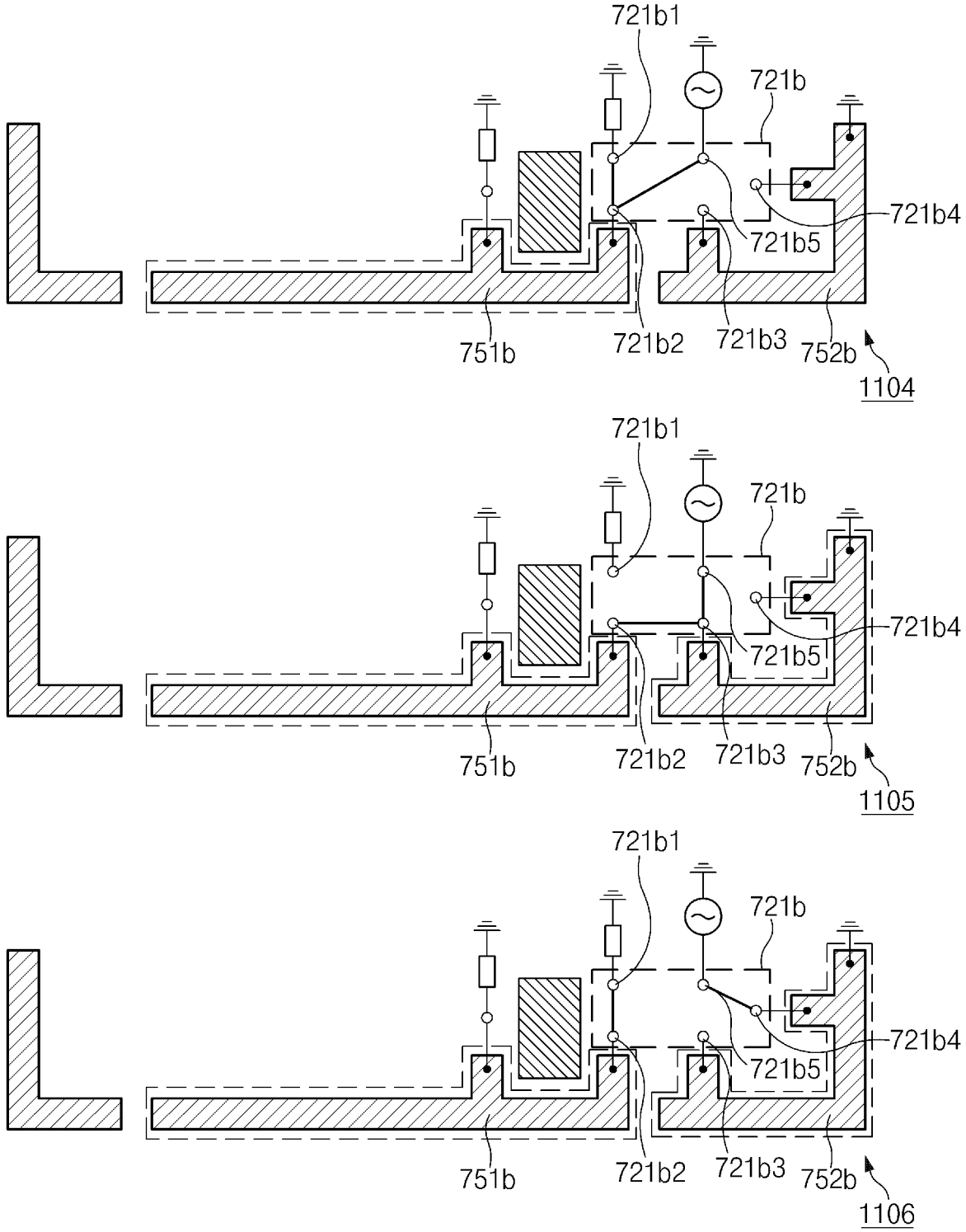
FIG. 11B is a view for describing a connection structure of a switch according to an embodiment of the present disclosure.

FIG. 11A is a view for describing radiation performance of lower-side antenna radiators according to an embodiment of the present disclosure. FIG. 11B is a view for describing a connection structure of a switch according to an embodiment of the present disclosure.

Referring to FIGS. 11A and 11B, lower-side antenna radiators 1101, 1102, and 1103 each including a first antenna radiator and a second antenna radiator according to various embodiments are illustrated. Each of the lower-side antenna radiators 1101, 1102, and 1103 may include the first antenna radiator 751*b* and the second antenna radiator 752*b* illustrated in FIG. 7B. Below, reference numerals of FIG. 7B will be used for convenience of description.

In the lower-side antenna radiator 1101 according to an embodiment of the present disclosure, the first node 721*b*1 and the second node 721*b*2 of the first switch 721*b* may be electrically connected to each other, and the third node 721*b*3 and the fifth node 721*b*5 thereof may be electrically connected to each other. The second antenna radiator 752*b* may be fed through the third node 721*b*3 and the fifth node 721*b*5. The lower-side antenna radiator 1101 may operate in a carrier aggregation mode, for example. A connection structure of the first switch 721*b* of the lower-side antenna radiator 1101 may correspond to, for example, a default configuration.

In the lower-side antenna radiator 1102 according to an embodiment of the present disclosure, the second node 721*b*2 and the third node 721*b*3 of the first switch 721*b* may be electrically connected to each other. The second antenna radiator 752*b* may be electrically connected with the first antenna radiator 751*b* through the second node 721*b*2 and the third node 751*b*3. Power may not be supplied from the fifth node 721*b*5.

In the lower-side antenna radiator 1103 according to an embodiment of the present disclosure, the first node 721*b*1 and the second node 721*b*2 of the first switch 721*b* may be electrically connected to each other, and the second node 721*b*2 and the third node 721*b*3 thereof may be electrically connected to each other. Power may not be supplied from the fifth node 721*b*5.

Radiation efficiency curves 1101*g*-1, 1102*g*-1, and 1103*g*-1 corresponding to frequencies of the lower-side antenna radiators 1101, 1102, and 1103 are illustrated in FIG. 11A; and reflection coefficient curves 1101*g*-2, 1102*g*-2, and 1103*g*-2 corresponding to frequencies of the lower-side antenna reflectors 1101, 1102, and 1103 are also illustrated in FIG. 11A. In a graph where the radiation efficiency curves 1101*g*-1, 1102*g*-1, and 1003*g*-1 are illustrated, a horizontal axis represents a frequency (MHz), and a vertical axis represents radiation efficiency (dB). In a graph where the reflection coefficient curves 1101*g*-2, 1102*g*-2, and 1003*g*-2 are illustrated, a horizontal axis represents a frequency (MHz), and a vertical axis represents a reflection coefficient (dB).

Referring to the radiation efficiency curve 1101*g*-1, the lower-side antenna radiator 1101 that operates in a carrier aggregation mode shows relatively improved radiation efficiency in the LB and the MB. Referring to the reflection coefficient curve 1101*g*-2, the lower-side antenna radiator 1101 that operates in a carrier aggregation mode shows relatively improved reflection coefficient in the LB and the MB.

Referring to the radiation efficiency curve 1102*g*-1, the lower-side antenna radiator 1102 shows higher radiation efficiency than that of the lower-side antenna radiator 1101 in a part of the LB. For example, the communication circuit may receive a signal of the LB with the intensity smaller than a specified value while the communication circuit operates in the carrier aggregation mode. The communication circuit may be controlled by a processor or the like so as to increase throughput of the LB. The communication circuit may supply a switch with a control signal for configuring a lower-side antenna radiator as the lower-side antenna radiator 1102 for improving a signal of the LB with the great intensity, (refer to operation 807 of FIG. 8).

Referring to the radiation efficiency curve 1103*g*-1, the lower-side antenna radiator 1103 shows better radiation efficiency than the curve 1101*g*-1 in the MB. Referring to the reflection coefficient curve 1103*g*-2, the lower-side antenna radiator 1103 shows a better reflection coefficient than the reflection coefficient curve 1101*g*-2 in a part of the MB. For example, a signal of the MB may be received with the intensity smaller than a specified value while the communication circuit operates in the carrier aggregation mode. The communication circuit may be controlled by a processor or the like so as to increase throughput of the MB. The communication circuit may supply a switch with a control signal for configuring a lower-side antenna radiator as the lower-side antenna radiator 1103 for improving a signal of the MB with the great intensity (refer to operation 809 of FIG. 8).

According to various embodiments of the present disclosure, a connection structure of the first switch 721*b* is not limited to an example illustrated in FIG. 11A. For example, switch connection structures according to various embodiments are illustrated in FIG. 11B.

According to an embodiment of the present disclosure, in a lower-side antenna radiator 1104, the first node 721*b*1 and the second node 721*b*2 of the first switch 721*b* may be electrically connected to each other, and the second node 721*b*2 and the fifth node 721*b*5 thereof may be electrically connected to each other. Transmit performance or receive sensitivity of a MB signal may be improved, for example, through the above-described switch connection structure of the lower-side antenna radiator 1104 (refer to operation 809 of FIG. 8).

According to an embodiment of the present disclosure, in a lower-side antenna radiator 1105, the second node 721*b*2 and the third node 721*b*3 of the first switch 721*b* may be electrically connected to each other, and the third node 721*b*3 and the fifth node 721*b*5 thereof may be electrically connected to each other. Transmit performance or receive sensitivity of a MB and/or HB signal may be improved, for example, through the above-described switch connection structure of the lower-side antenna radiator 1105 (refer to operations 809, 811, and 819 of FIG. 8).

According to an embodiment of the present disclosure, in a lower-side antenna radiator 1106, the first node 721*b*1 and the second node 721*b*2 of the first switch 721*b* may be electrically connected to each other, and the fourth node 721*b*4 and the fifth node 721*b*5 thereof may be electrically connected to each other. Transmit performance or receive sensitivity of a HB signal may be improved, for example, through the above-described switch connection structure of the lower-side antenna radiator 1106 (refer to operation 811 of FIG. 8).

Figure 12A:
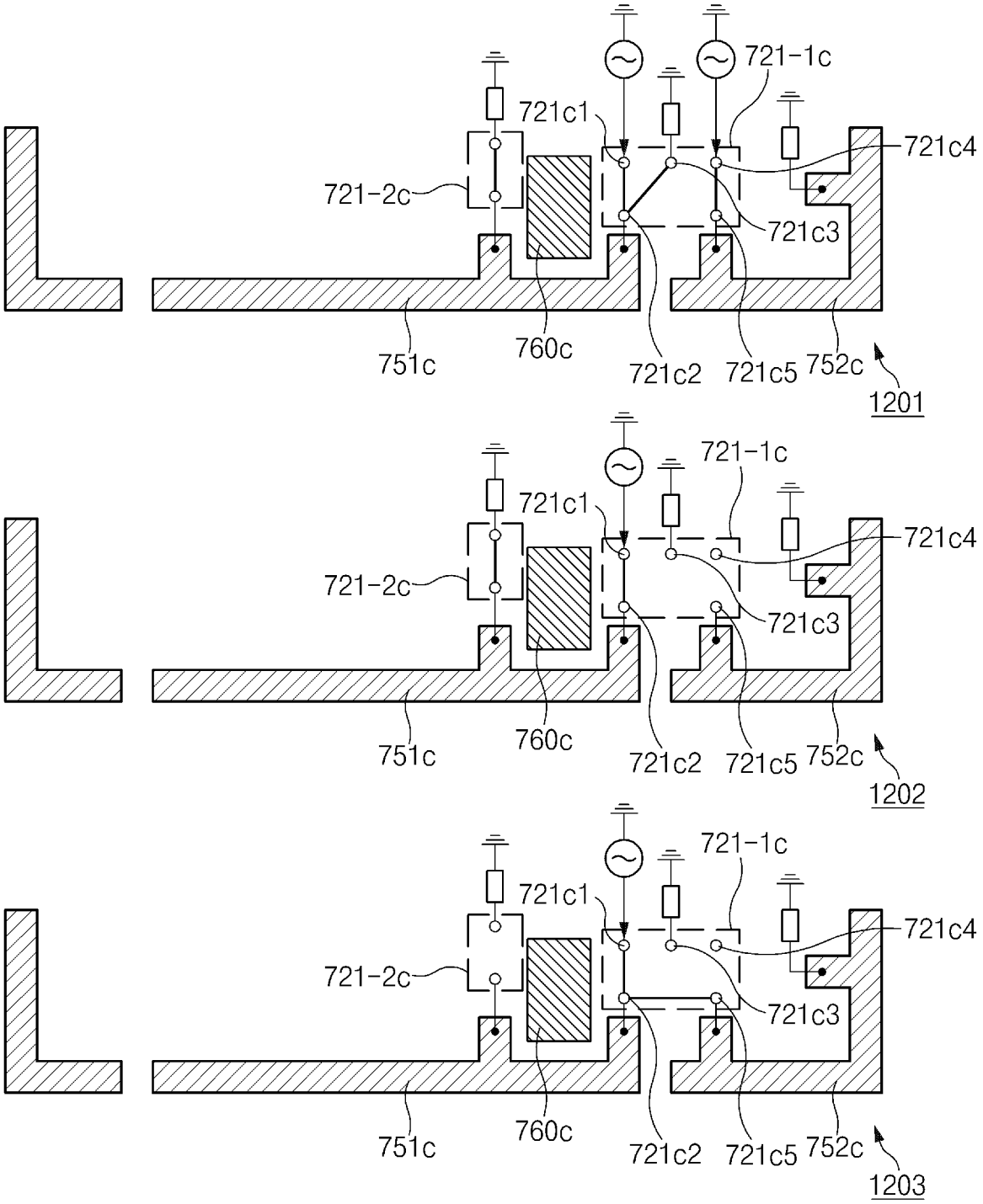
FIGS. 12A and 12B are views for describing an operation of a switch according to various embodiments of the present disclosure.
Figure 12B:
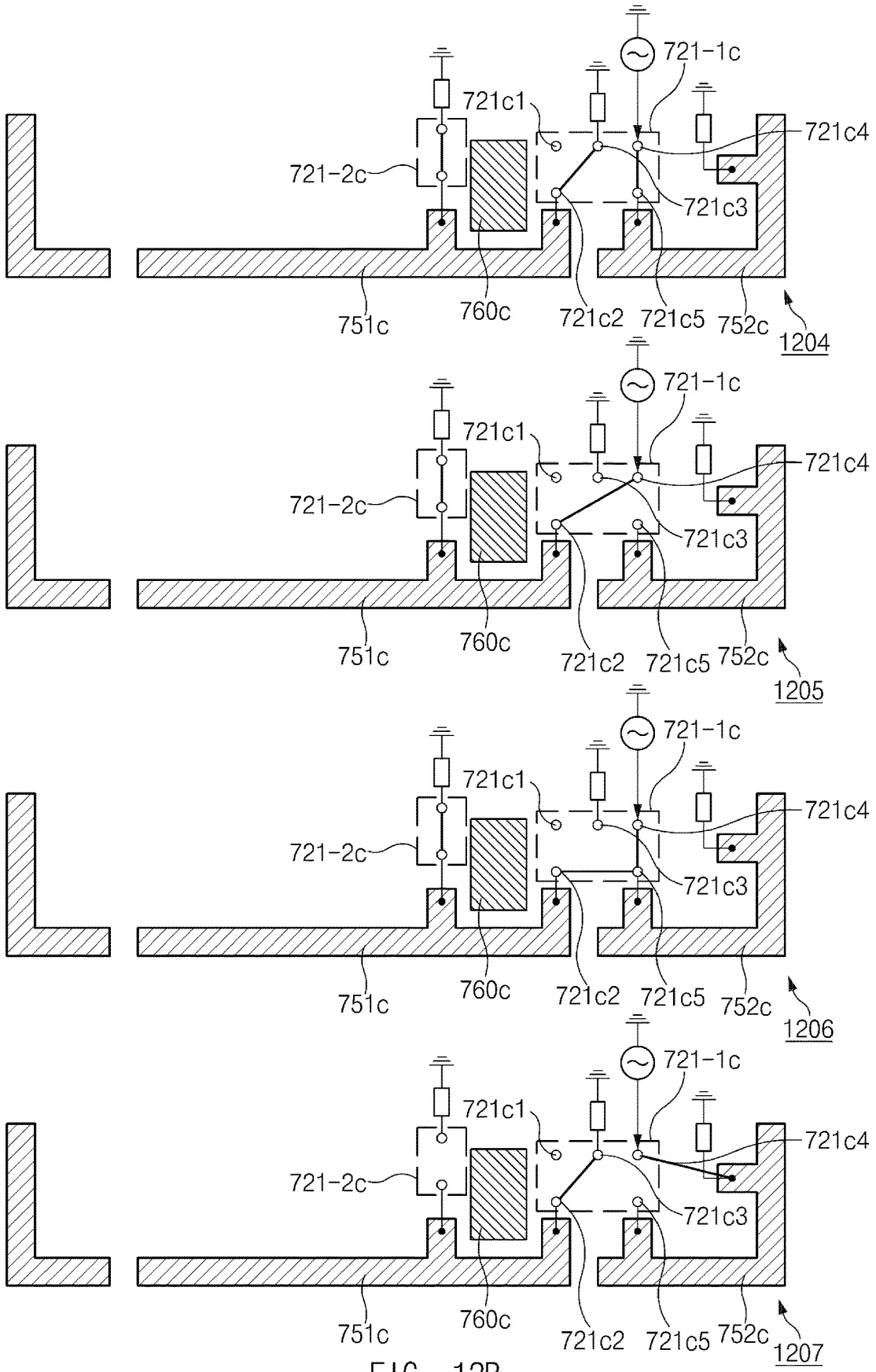

FIGS. 12A and 12B are views for describing an operation of a switch according to various embodiments of the present disclosure.

Referring to FIGS. 12A and 12B, lower-side antenna radiators 1201 to 1207 each including a first antenna radiator and a second antenna radiator according to various embodiments are illustrated. Each of the lower-side antenna radiators 1201 to 1207 may include the first antenna radiator 751*c* and the second antenna radiator 752*c* illustrated in FIG. 7C. Below, reference numerals of FIG. 7C will be used for convenience of description.

Referring to FIG. 12A, in the lower-side antenna radiator 1201 the first node 721*c*1 and the second node 721*c*2 of the first switch 721-1*c* may be electrically connected to each other; the second node 721*c*2 and the third node 721*c*3 thereof may be electrically connected to each other; and the fourth node 721*c*4 and the fifth node 721*c*5 thereof may be electrically connected to each other. The second switch 721-2*c* may close. Transmit performance or receive sensitivity of a signal in which a MB and a HB are aggregated may be improved, for example, through the above-described switch connection structure of the lower-side antenna radiator 1201 (refer to operation 819 of FIG. 8).

In the lower-side antenna radiator 1202 according to an embodiment of the present disclosure, the first node 721*c*1 and the second node 721*c*2 of the first switch 721-1*c* may be electrically connected to each other. The second switch 721-2*c* may close. Transmit performance or receive sensitivity of a LB and/or MB signal may be improved, for example, through the above-described switch connection structure of the lower-side antenna radiator 1202 (refer to operations 807, 809, and 815 of FIG. 8).

In the lower-side antenna radiator 1203 according to an embodiment of the present disclosure, the first node 721*c*1 and the second node 721*c*2 of the first switch 721-1*c* may be electrically connected to each other, and the second node 721*c*2 and the third node 721*c*3 thereof may be electrically connected to each other. The second switch 721-2*c* may open. Transmit performance or receive sensitivity of a LB signal may be improved, for example, through the above-described switch connection structure of the lower-side antenna radiator 1203 (refer to operation 807 of FIG. 8).

According to an embodiment of the present disclosure, in the lower-side antenna radiator 1204 illustrated in FIG. 12B, the second node 721*c*2 and the third node 721*c*3 of the first switch 721-1*c* may be electrically connected to each other, and the fourth node 721*c*4 and the fifth node 721*c*5 thereof may be electrically connected to each other. The second switch 721-2*c* may close. Transmit performance or receive sensitivity of a MB and/or HB signal may be improved, for example, through the above-described switch connection structure of the lower-side antenna radiator 1204 (refer to operations 809, 811, and 819 of FIG. 8).

According to an embodiment of the present disclosure, in the lower-side antenna radiator 1205, the second node 721*c*2 and the fourth node 721*c*4 of the first switch 721-1*c* may be electrically connected to each other. The second switch 721-2*c* may close. Transmit performance or receive sensitivity of a MB signal may be improved, for example, through the above-described switch connection structure of the lower-side antenna radiator 1205 (refer to operation 809 of FIG. 8).

According to an embodiment of the present disclosure, in the lower-side antenna radiator 1206, the second node 721*c*2 and the fifth node 721*c*5 of the first switch 721-1*c* may be electrically connected to each other, and the fourth node 721*c*4 and the fifth node 721*c*5 thereof may be electrically connected to each other. The second switch 721-2*c* may close. Transmit performance or receive sensitivity of a MB and/or HB signal may be improved, for example, through the above-described switch connection structure of the lower-side antenna radiator 1204 (refer to operations 809, 811, and 819 of FIG. 8).

According to an embodiment of the present disclosure, in the lower-side antenna radiator 1207, the second node 721*c*2 and the third node 721*c*3 of the first switch 721-1*c* may be electrically connected to each other, and the fourth node 721*c*4 thereof may be electrically connected with the second antenna radiator 752*c* at a position. The second switch 721-2*c* may close. Transmit performance or receive sensitivity of a HB signal may be improved, for example, through the above-described switch connection structure of the lower-side antenna radiator 1207 (refer to operation 811 of FIG. 8).

According to various embodiments of the present disclosure, a connection structure of the first switch 721-1*c* is not limited to an example illustrated in FIGS. 12A and 12B. Nodes included in the first switch 721-1*c* may be electrically connected to each other in various combinations.

In an antenna structure, according to various embodiments of the present disclosure, based on a specified control signal, positions of a feeding unit and a ground of an antenna may be adjusted or two or more fixed antenna radiators may be connected to each other. Accordingly, it may be possible to flexibly cope with to-be-developed communication technologies in addition to existing communication technologies, such as a typical single input single output (SISO) technology, a multi input multi output (MIMO) technology for two or more data streams, a CA technology for combing two or more frequency bands, and a 4Rx technology for using four receive antennas.

An electronic device according to an embodiment may include a housing, a wireless communication circuit, a first antenna radiator electrically connected with a first ground, a second antenna radiator electrically connected with a second ground, a feeding unit that feeds at least one of the first antenna radiator or the second antenna radiator, and a first switch that operates at a first connection state where the feeding unit and the first antenna radiator are electrically connected to each other, at a second connection state where the feeding unit and the second antenna are electrically connected to each other, or at a third connection state where the feeding unit and the first antenna radiator are connected to each other and the feeding unit and the second antenna radiator are electrically connected to each other, based on a first control signal from the wireless communication circuit.

According to another embodiment of the present disclosure, an electrical length of the first antenna radiator may be designed to be longer than an electrical length of the second antenna radiator.

According to another embodiment of the present disclosure, the first antenna radiator and the second antenna radiator may form part of the housing.

According to another embodiment of the present disclosure, the communication circuit may sense a state of a signal resonating at the first antenna radiator and the second antenna radiator, may identify a frequency band of a signal, in which a parameter indicating an intensity or communication quality of the signal is smaller than a specified value, and may provide the first switch with the first control signal to transmit and receive the signal of the identified frequency band with a value greater than the specified value.

According to another embodiment of the present disclosure, the parameter indicating the intensity or communication quality of the signal may include at least one of a signal to noise ratio, a bits error ratio, an energy per chip ratio (Ec/Io), a DL data rate, RSCP, or a RSSI.

According to another embodiment of the present disclosure, in the case where a frequency band of a signal sensed as having a value smaller than the specified value includes at least part of a first frequency band or a second frequency band higher than the first frequency band, the first switch may operate at the first connection state in response to the first control signal.

According to another embodiment of the present disclosure, in the case where a frequency band of a signal sensed as having a value smaller than the specified value includes at least part of a third frequency band, the first switch may operate at the second connection state in response to the first control signal.

According to another embodiment of the present disclosure, the wireless communication circuit may perform CA. In the case where a frequency band of a signal sensed as having a value smaller than the specified value includes at least part of a frequency band where the carrier aggregation is made, the first switch may operate at the third connection state in response to the first control signal.

According to another embodiment of the present disclosure, the electronic device may further include a third antenna radiator electrically connected with a third ground, a second feeding unit that feeds the third antenna radiator at any one of a first position of the third antenna radiator or a second position of the third antenna radiator, and a second switch that electrically connects the second feeding unit and the first position or the second feeding unit and the second position in response to a second control signal from the wireless communication circuit.

According to another embodiment of the present disclosure, the electronic device may further include a third antenna radiator, a second feeding unit that feeds the third antenna radiator, a third ground electrically connected with the third antenna radiator at a first position of the third antenna radiator, and a fourth ground electrically connected with the third antenna radiator through a second switch at a second position of the third antenna radiator. The second switch may open or close in response to the second control signal from the wireless communication circuit.

According to another embodiment of the present disclosure, the first position and the second position may be spaced apart from each other by a specified electrical length.

An electronic device according to an embodiment may include a wireless communication circuit, a first antenna radiator, a second antenna radiator, a first ground electrically connected with the first antenna element, a second ground associated with the first antenna element, a third ground electrically connected with the second antenna element, a first feeding unit that feeds the first antenna radiator, a second feeding unit that feeds at least one of the first antenna radiator and the second antenna radiator, and a switch that electrically connects at least two or more of the first antenna radiator, the second antenna radiator, the second ground, and the second feeding unit based on a control signal from the wireless communication circuit.

According to another embodiment of the present disclosure, the wireless communication circuit may sense a state of a signal resonating at the first antenna radiator and the second antenna radiator, may identify a frequency band of a signal, in which a parameter indicating an intensity or communication quality of the signal is smaller than a specified value, and may provide the switch with the control signal to transmit and receive the signal of the identified frequency band with a value greater than the specified value.

According to another embodiment of the present disclosure, in the case where a frequency band of a signal sensed as having a value smaller than the specified value includes at least part of a first frequency band, the switch may electrically connect the first antenna radiator and the second antenna radiator in response to the control signal.

According to another embodiment of the present disclosure, in the case where a frequency band of a signal sensed as having a value smaller than the specified value includes at least part of a second frequency band higher than the first frequency band, the switch may electrically connect the first antenna radiator, the second antenna radiator, and the second ground in response to the control signal.

According to another embodiment of the present disclosure, the wireless communication circuit may perform carrier aggregation on a signal of a second frequency band and a signal of a third frequency band higher than the second frequency band. In the case where a frequency band of a signal sensed as having a value smaller than the specified value includes at least part of a frequency band where the carrier aggregation is made, the switch may electrically connect the first antenna radiator, the second antenna radiator, and the second feeding unit in response to the control signal.

An electronic device according to an embodiment may include a wireless communication circuit.

A first feeding unit, a second feeding unit, a first antenna radiator, a second antenna radiator, a first ground associated with the first antenna element, a second ground associated with the first antenna element, a third ground electrically connected with the second antenna element, and a first switch that electrically connects at least two or more of the first feeding unit, the second feeding unit, the first antenna radiator, the second antenna radiator, and the second ground based on a first control signal from the wireless communication circuit.

According to another embodiment of the present disclosure, the wireless communication circuit may sense a state of a signal resonating at the first antenna radiator and the second antenna radiator, may identify a frequency band of a signal, in which a parameter indicating an intensity or communication quality of the signal is smaller than a specified value, and may provide the first switch with the first control signal to transmit and receive the signal of the identified frequency band with a value greater than the specified value.

According to another embodiment of the present disclosure, the first ground may be connected with the first antenna radiator through a second switch, and the second switch may open or close in response to a second control signal from the wireless communication circuit.

According to another embodiment of the present disclosure, in the case where a frequency band of a signal sensed as having a value smaller than the specified value includes at least part of a first frequency band, the first switch may electrically connect the first antenna radiator, the second antenna radiator, and the first feeding unit in response to the first control signal, and the second switch may open in response to the second control signal.

According to another embodiment of the present disclosure, the communication circuit may perform carrier aggregation on a signal of a second frequency band and a signal of a third frequency band higher than the second frequency band. In the case where a frequency band of a signal sensed as having a value smaller than the specified value includes at least part of a frequency band where the carrier aggregation is made, the first switch may electrically connect the first antenna radiator, the second antenna radiator, and the second feeding unit in response to the first control signal, and the second switch may close in response to the second control signal.

An electronic device according to an embodiment may include a housing, a display that is exposed through a first part of the housing, a first antenna radiator that is located within the housing or forms part of the housing, a second antenna radiator that is located within the housing or forms another part of the housing, a wireless communication circuit that transmits and/or receives a signal of a first frequency band, a switching circuit that includes a first port electrically connected with a first position of the first antenna radiator, a second port electrically connected with a second position of the second antenna radiator, and a third position electrically connected with the wireless communication circuit, and a control circuit electrically connected with the switching circuit. The control circuit may provide one state identified from a first state where an electrical path is formed only between the first port and the second port, at a second state where an electrical path is formed only between the second port and the third port, and at a third state where electrical paths are formed between the first port, the second port, and the third port.

According to another embodiment of the present disclosure, the housing may include a first surface, a second surface facing an opposite direction of the first surface, and a side surface surrounding a space between the first surface and the second surface, the first antenna radiator may form a first portion of the side surface, and the second antenna radiator may form a second portion, which is adjacent to the first portion, of the side surface.

The electronic device may further include a nonconductor interposed between the first portion and the second portion.

According to another embodiment of the present disclosure, the first antenna radiator may include a third position electrically connected to a ground, the second antenna radiator may include a fourth position electrically connected to a ground, the first position may be closer to the nonconductor than the third position, and the first position may be closer to the nonconductor than the third position.

According to another embodiment of the present disclosure, the first frequency band may include at least one of 600 MHz to 990 MHz, 1400 MHz to 2200 MHz, 2200 MHz to 2700 MHz, or 2400 MHz to 5900 MHz.

The term "module" used in this disclosure may represent, for example, a unit including one or more combinations of hardware, software and firmware. The term "module" may be interchangeably used with the terms "unit", "logic", "logical block", "component" and "circuit." The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor 120), may cause the one or more processors to perform a function corresponding to the instruction. The computer-readable storage media, for example, may be the memory 130.

A computer-readable recording medium may include a hard disk, a floppy disk, a magnetic media (e.g., a magnetic tape), an optical media (e.g., a CD-ROM and a DVD, a magneto-optical media (e.g., a floptical disk)), and hardware devices (e.g., a ROM), a RAM, or a flash memory). In addition, a program instruction may include not only a mechanical code, such as things generated by a compiler but also a high-level language code executable on a computer using an interpreter. The above hardware unit may be configured to operate via one or more software modules for performing an operation according to various embodiments of the present disclosure, and vice versa.

A module or a program module according to various embodiments may include at least one of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

In an antenna structure according to various embodiments of the present disclosure, based on a specified control signal, positions of a feeding unit and a ground of an antenna may be adjusted or two or more fixed antenna radiators may be connected to each other. Accordingly, it may be possible to flexibly cope with to-be-developed communication technologies in addition to existing communication technologies, such as a typical SISO technology, a MINO technology for two or more data streams, a CA technology for combing two or more frequency bands, and a 4Rx technology for using four receive antennas. Besides, a variety of effects directly or indirectly understood through this disclosure may be provided.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing;

a wireless communication circuit;

an antenna radiator including:

a single radiator extended in a first direction, a first protruding part extended in a second direction from a first portion of the single radiator, a second protruding part extended in the second direction from a second portion of the single radiator, and a third protruding part extended in the second direction from a third portion of the single radiator, and electrically connected with a ground;

a feeding unit configured to feed at least a portion of the antenna radiator; and a switch configured to:

operate at a first connection state where the feeding unit and the antenna radiator are electrically connected via the first protruding part of the antenna radiator, and operate at a second connection state where the feeding unit and the antenna radiator are electrically connected via the second protruding part of the antenna radiator, wherein the first portion is spaced apart from the third portion in the first direction, wherein the second portion is positioned between the first portion and the third portion, and wherein a first wavelength corresponding to the first portion at the first connection state is different from a second wavelength corresponding to the second portion at the second connection state.

2. The electronic device of claim 1, wherein the first portion and the second portion are spaced apart from each other by a specified electrical length on the antenna radiator.

3. The electronic device of claim 1, wherein the antenna radiator forms a part of the housing.

4. The electronic device of claim 1, wherein a lumped element is connected between the switch and the second portion of the antenna radiator.

5. The electronic device of claim 1, wherein the wireless communication circuit is configured to:

detect a signal resonating at the antenna radiator, identify a frequency band of the signal, in which a parameter indicating an intensity or a communication quality of the signal is smaller than a specified value, and provide the switch with a control signal based on the identified frequency band of the signal.

6. The electronic device of claim 5, wherein the parameter indicating the intensity or the communication quality of the signal includes at least one of a signal to noise ratio, a bits error ratio, an energy per chip ratio (Ec/lo), a downlink (DL) data rate, received signal code power (RSCP), or a received signal strength indicator (RSSI).

7. The electronic device of claim 5, wherein, in a case where the frequency band of the signal having a value smaller than the specified value includes at least a part of a first frequency band, the switch operates at the first connection state in response to the control signal.

8. The electronic device of claim 5, wherein, in a case where the frequency band of the signal having a value smaller than the specified value includes at least part of a second frequency band higher than a first frequency band, a first switch operates at the second connection state in response to a first control signal.

* * * * *